US011672344B2

(12) United States Patent
DuFresne

(10) Patent No.: US 11,672,344 B2
(45) Date of Patent: Jun. 13, 2023

(54) SUPPORT SURFACE

(71) Applicant: Anthro Form, LLC, Waukesha, WI (US)

(72) Inventor: Steven DuFresne, Hartland, WI (US)

(73) Assignee: Anthro Form, LLC, Waukesha, WI (US)

( * ) Notice: Subject to any disclaimer, the term of this patent is extended or adjusted under 35 U.S.C. 154(b) by 0 days.

(21) Appl. No.: 17/864,997

(22) Filed: Jul. 14, 2022

(65) Prior Publication Data

US 2023/0036247 A1 Feb. 2, 2023

Related U.S. Application Data

(60) Provisional application No. 63/351,191, filed on Jun. 10, 2022, provisional application No. 63/221,657, filed on Jul. 14, 2021.

(51) Int. Cl.

| | |
|---|---|
| ***A47C 7/18*** | (2006.01) |
| ***A47C 7/24*** | (2006.01) |
| ***A47C 7/02*** | (2006.01) |
| ***A47C 31/12*** | (2006.01) |

(52) U.S. Cl.
CPC ..... *A47C 7/029* (2018.08); *A47C 7/24* (2013.01); *A47C 31/126* (2013.01)

(58) Field of Classification Search
CPC ..... A47C 7/029; A47C 7/24; A47C 27/148
USPC ..... 297/452.21, 452.22, 452.23, 452.24, 297/452.25, 452.26, 452.27
See application file for complete search history.

(56) References Cited

U.S. PATENT DOCUMENTS

| | | | | |
|---|---|---|---|---|
| 2,063,081 A | | 12/1936 | Franklin | |
| 2,384,713 A | * | 9/1945 | Varma | B60N 2/7005 5/653 |
| 2,750,996 A | | 6/1956 | Cramer | |
| 2,819,712 A | * | 1/1958 | Morrison | A47C 27/082 5/655.3 X |

(Continued)

FOREIGN PATENT DOCUMENTS

| | | |
|---|---|---|
| CN | 106109139 A | 11/2016 |
| DE | 1729093 A1 | 6/1971 |

(Continued)

OTHER PUBLICATIONS

Partial International Search Report for PCT/US2022/037141, dated Nov. 9, 2022, 30 pages.

(Continued)

*Primary Examiner* — Rodney B White
(74) *Attorney, Agent, or Firm* — Boardman & Clark LLC

(57) ABSTRACT

A support surface including a cutout on a bottom surface of the support surface. The cutout, which can include a plurality of cutouts, provides a controlled structural collapse of the support surface by varying a stiffness in a cross-section. That is, the area in which the cutouts are positioned collapses more easily than the surrounding area of the support structure, thus making the area with the cutouts perceived as being softer. The cutouts can reduce the peak pressures on the portion of the user's body (for example, the user's ischial tuberosities) that is positioned over the cutouts. The support surface can also include a low-friction interface extending across a top surface of the support surface.

12 Claims, 15 Drawing Sheets

(56) References Cited

U.S. PATENT DOCUMENTS 2,933,738 A * 4/1960 Whelan ..... A47C 20/027 5/630
3,158,878 A * 12/1964 Pernell ..... A61G 7/05723 5/653 X
3,315,282 A * 4/1967 Lowery ..... A47G 9/1054 5/638 X
3,337,884 A * 8/1967 Meier ..... B60N 2/7035 297/452.26 X
3,531,157 A * 9/1970 Duckett ..... A47C 7/16 297/452.21 X
3,987,507 A * 10/1976 Hall ..... A61G 5/1091 5/653
4,235,472 A * 11/1980 Sparks ..... A47C 7/383 5/639
4,682,818 A * 7/1987 Morell ..... A61G 5/1045 297/452.27 X
4,753,480 A * 6/1988 Morell ..... A61G 7/05715 297/452.27 X
4,781,417 A * 11/1988 Shipman ..... B60N 2/686 297/452.24 X
5,079,790 A * 1/1992 Pouch ..... A61G 7/05784 5/653
5,163,737 A * 11/1992 Navach ..... A47C 7/029 297/452.25 X
5,226,188 A * 7/1993 Liou ..... A47C 7/742 5/653
5,282,286 A * 2/1994 MacLeish ..... A61G 5/1045 5/655.3
5,395,162 A 3/1995 Jay et al.
5,414,884 A * 5/1995 Mackenzie ..... A61G 7/05723 5/653
5,442,823 A 8/1995 Siekman et al.
5,444,881 A * 8/1995 Landi ..... B29D 99/0089 428/116
5,499,413 A * 3/1996 Van Hekken ..... A47C 7/185 297/452.27 X
5,519,907 A * 5/1996 Poths ..... A47C 27/144 5/636
5,533,218 A * 7/1996 Fahy ..... A47C 27/16 5/636
5,617,595 A * 4/1997 Landi ..... A61G 7/05784 428/116
5,836,654 A 11/1998 Debellis et al.
5,960,494 A * 10/1999 Gilliland ..... A61G 13/0081 5/638 X
6,067,777 A * 5/2000 Stoll ..... B60N 2/6081 53/442
6,082,824 A * 7/2000 Chow ..... A61G 5/1045 297/452.27 X
6,125,851 A 10/2000 Walker et al.
6,471,726 B2 * 10/2002 Wang ..... A47G 9/10 5/636
6,598,251 B2 * 7/2003 Habboub ..... B60N 2/56 5/724
7,140,057 B2 * 11/2006 Hetzel ..... A61G 5/1043 297/452.26 X
7,216,388 B2 * 5/2007 Bieganek ..... A47C 7/029 297/452.26 X
7,347,498 B2 3/2008 Clifford
7,444,707 B2 11/2008 O'Reagan
7,530,640 B2 * 5/2009 Walters ..... A47C 7/18 297/452.27 X
7,614,704 B2 11/2009 Whelan et al.
7,624,462 B2 12/2009 Coa et al.
7,661,764 B2 * 2/2010 Ali ..... B60N 2/646 297/452.26
7,681,265 B2 3/2010 Fraser
7,934,774 B2 5/2011 Galbreath et al.
8,020,937 B2 * 9/2011 Partington ..... B60N 2/7035 5/652
8,056,166 B2 * 11/2011 Calvert ..... A47G 9/1063 5/639
8,215,714 B2 * 7/2012 Galbreath ..... B60N 2/70 297/452.27 X
8,291,535 B2 * 10/2012 Kemper ..... A61G 5/1045 297/452.27 X
8,919,885 B2 * 12/2014 Han ..... A47C 7/0213 297/452.24 X
9,038,252 B2 * 5/2015 Ali ..... B68G 7/00 297/452.26 X
D748,421 S * 2/2016 Warner ..... D6/349
10,104,968 B2 10/2018 Alvarez et al.
10,486,565 B2 11/2019 Sweeting et al.
10,792,208 B2 10/2020 Saunders et al.
10,986,936 B2 4/2021 Dahl et al.
11,382,428 B2 * 7/2022 Proctor ..... A47C 27/065
2005/0022306 A1 * 2/2005 Hetzel ..... A61G 5/1045 5/654
2007/0096534 A1 * 5/2007 Davidson ..... A47C 7/20 297/452.27
2008/0079306 A1 * 4/2008 Whelan ..... A47C 7/029 297/452.41
2011/0000018 A1 * 1/2011 Kirchhoff ..... A47C 27/148 219/490
2013/0193738 A1 * 8/2013 Siekman ..... A47C 7/02 297/452.56
2014/0182049 A1 * 7/2014 Prust ..... A42B 3/12 36/43
2016/0166063 A1 * 6/2016 Siekman ..... A47C 7/02 297/452.26
2016/0375807 A1 12/2016 Kageyama et al.
2017/0000263 A1 * 1/2017 Krishtul ..... A47C 7/029
2017/0072653 A1 3/2017 Dahl et al.
2017/0354258 A1 12/2017 Keen
2020/0238658 A1 6/2020 Caboillet et al.
2022/0053944 A1 * 2/2022 Rajaratnam ..... A47C 27/16

FOREIGN PATENT DOCUMENTS

EP 2798980 A1 11/2014
EP 3849382 A1 6/2022
ES 2708725 T3 4/2019
GB 2193437 A * 2/1988 ..... A47C 27/146
JP 2003000394 A 7/2008
JP 4686678 B2 5/2011
JP 2014158571 A 9/2014
JP 2021045417 A 3/2021
JP 2019042421 A 8/2021
KR 20090013321 A * 2/2009 ..... A47C 7/029
KR 20130062621 A * 6/2013 ..... A47C 7/029

OTHER PUBLICATIONS

International Search Report and Written Opinion of the International Search Authority dated Mar. 10, 2023, received in connection with International Application No. POT/US2022/037141 filed Jul. 14, 2022.

* cited by examiner

SUPPORT SURFACE

CROSS-REFERENCE TO RELATED APPLICATIONS

This application claims priority to and the benefit of U.S. Provisional Patent Application No. 63/351,191 filed Jun. 10, 2022, entitled "SEAT SUPPORT SURFACE"; and claims priority to and the benefit of U.S. Provisional Patent Application No. 63/221,657 filed Jul. 14, 2021, entitled "SUPPORT SURFACE"; the entire contents of both are hereby incorporated by reference herein in their entireties.

BACKGROUND

Seat cushions are typically made of a durable cushion material, such as foam, gel, or air-filled bladders. Foam is typically used in seating because it rebounds more easily and lasts longer than other options, such as cushions stuffed with polyester fill or feathers/down. Foam cushions are often poured or injection molded or milled to create a cushion with a finished or desired shape. Alternatively, the foam cushion can be cut from a larger foam block to the contours of the desired cushion shape.

While foam cushions are the most popular choice for durable and cost-effective seating, foam cushions can be uncomfortable for a user sitting for long periods of time. Specifically, single density foam cushions can cause high sitting pressures (typically measured in mm Hg) and induce high shear forces. These high sitting pressures and shear strain can lead to the irritation of a user's nociceptors, specifically mechanoreceptors, and trigger a pain signal in the brain. This signal is sent up the spinal cord, into the brain, modulated, and a perception of the pain is given to the individual, who takes action (e.g., adjusts to a new position) if needed. High sitting pressures and shear forces are usually processed by the user's brain simply as "too uncomfortable," particularly if the user is sitting for durations longer than 5 to 10 minutes. The user's ischial tuberosities (ITs or sit bones) are very sensitive and very responsive to sitting pain in a self-preservation mode to prevent tissue breakdown. Left unchecked, tissue breakdown may lead to necrosis, which yields a pressure or shear strain injury.

SUMMARY

A support surface described herein is designed to reduce the pressure on the user's IT's, which allows a user to sit more comfortably for a longer period of time without fidgeting or repositioning themselves in the seat. The example support surface can also be easily manufactured using relatively inexpensive materials. Thus, the support surface may be available for a number of different uses and accessible by a larger portion of the population (compared to existing support surfaces that reduce the peak pressures to similar levels as the example support surface).

An example support surface described herein includes cutouts on a bottom surface of the seat support surface. The cutouts provide a controlled structural collapse of the support surface by varying a stiffness in a cross-section. That is, the area in which the cutouts are positioned collapses more easily than the surrounding area of the support structure, thus making the area with the cutouts perceived as being softer. The cutouts reduce the peak pressures on the portion of the user's body (ideally the IT's) that is positioned over the cutouts. The support surface also includes a low-friction interface extending across a top surface of the support surface, the low-friction interface positioned between the cutouts on the bottom surface and the user's bony prominences, wherein the low-friction interface is a low-friction fabric. The low-friction interface extending across the support surface and the low-friction fabric reduces shear strain in the seating plane of the user. The support surface can also or alternatively include a cut extending through the support surface, the cut positioned between the cutouts on the bottom surface and the user's bony prominences, wherein a low-friction fabric is positioned within the cut. The cut extending through the support surface and the low-friction fabric reduces shear strain in the seating plane of the user.

An example chair is described herein that includes the support surface. The support surface includes a top surface contoured to accommodate a pelvis of a user and a bottom surface. Cutouts on the bottom surface provide a controlled structural collapse of the support surface by varying a stiffness in a cross-section.

As mentioned, the support surface can be used in a variety of different applications in addition to the described chair. Such applications may include, but are not limited to, vehicle seats (including bus or train or any other public transportation seats), airplane seats, farming equipment seats, or any other possible use for support surfaces. The concept of the cutouts in a support surface to reduce peak pressures of an area of the body may also be applied to wheelchairs, mattresses, or other furniture.

The support surface can also or alternatively include a low-friction interface extending across a top surface of the support surface, the low-friction interface positioned between the cutouts on the bottom surface and the user's bony prominences, wherein the low-friction interface is a low-friction fabric. The low-friction interface extending across the support surface and the low-friction fabric reduces shear strain in the seating plane of the user.

The support surface can also or alternatively include a cut extending through the support surface, the cut positioned between the cutouts on the bottom surface and the user's bony prominences, wherein a low-friction fabric is positioned within the cut. The cut extending through the support surface and the low-friction fabric reduces shear strain in the seating plane of the user.

BRIEF DESCRIPTION OF THE DRAWINGS

Various examples of embodiments of the systems, devices, and methods according to this invention will be described in detail, with reference to the following figures.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
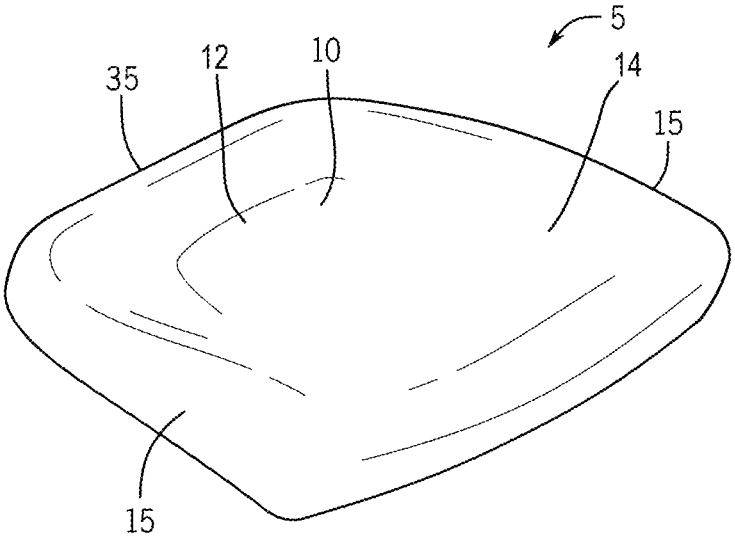
FIG. 1 depicts a perspective view of an example seat support surface.

FIG. 1 is a perspective view of an example seating surface or support surface 5 (e.g., a cushion) described herein. The example seat support surface 5 is made of foam (e.g., a poured foam, an injection molded foam, etc.) that may be molded, milled, cut, or otherwise formed into the desired shape for a particular application. The support surface 5 may be used with most any type of seating, such as but not limited to an office chair, airplane seating, vehicle seating, industrial equipment seating, stadium seating, theater seating, residential seating, bus seating, train seating, etc. The support surface 5 described herein may be covered using almost any upholstery method with almost any suitable fabric or non-fabric material that is sufficiently elastic to accommodate the change in shape of the support surface 5. The support surface 5 may be used with or without a cover and may be a self-skinning foam such as an EVA injection molded foam or a closed cell resin.

A top surface 10 of the support surface 5 is contoured, the sides 15 of the support surface 5 are raised, and the front edge 20 of the support surface 5 is tapered (e.g., undercut, relief cut). Additionally, the contoured top surface 10 includes a pelvic well 12 and an inclined femoral surface 14. The pelvic well 12 and inclined surface 14 aid in providing a force in the posterior direction to stabilize the pelvis and prevent translation in the anterior direction on the seat support surface 5, thereby positioning the user over pressure and shear strain relief features. The top surface 10 may be contoured according to the shape of the pelvic area of a user. The contour of the top surface 10 better matches the negative surface of the human body in a seated position than a flat seating surface. Matching the shape helps greatly reduce seating pressures under the IT's and coccyx compared to the flat-topped seating surfaces or cushions. The sides 15 may be raised to help guide a user into the center of the seat. The raised sides 15 are also complimentarily contoured to match the user's shape to help load the tissue and muscle lateral to the pelvis and along the femur area. This surface helps carry the load of the patient and redistributes pressures over a greater sitting area. The front edge 20 may be tapered backward to act as a relief cut that more closely follow the popliteal fossa downward along the calf muscle. The relief cut helps mitigate contacting these areas, thus reducing the chance of restricting blood flow to one's lower extremities. For the implementation of FIGS. 1-3, the design of the front edge 20 of the support surface 5 allows the front edge 20 of the seat to collapse under the weight of the user's legs without an edge of a seat pan (such as the seat pan in FIGS. 8 and 9) contacting and causing pressure on the user's legs. The front edge 20 of the seat pan may be low (compared to a traditional seat pan) to allow plenty of space for the foam to crush under the weight of the user's legs while without coming in contact of the hard front edge of the seat pan, which would cause a sharp pressure to the user's skin and other tissue that could lead to a pressure injury.

Additionally, the support surface 5 described herein reduces peak pressures on the user's ischial tuberosities due to a number of pressure reduction features (e.g., cutouts) 25 integrated in the bottom side or bottom surface 30 of the support surface 5. The example support surface 5 provides reduced peak pressures compared to a prior foam cushion. As referred to herein, the cutouts 25 may include holes, domes, indents, etc. The cutouts 25 change the cross-sectional stiffness of the support surface 5 in specific regions, particularly in the regions located under bony prominences, such as areas in which the ischial tuberosities or coccyx are placed. The reduced cross-sectional stiffness in the regions the ischial tuberosities are positioned on the support surface 5 reduces the peak pressures experienced by some or all of the ischial tuberosities. For example, the peak pressures may be reduced by as much as 60 mm Hg for a standard size male user. Specifically, the peak pressures, in at least one variation, was lowered to a value of 77 mm Hg using the support surface 5 with the cutouts 25 as described herein, as opposed to a mesh seating surface, which typically has peak pressures around 152 mm Hg.

The peak pressures are reduced using the support structure 5 because the support surface 5 includes controlled structural collapse built into the support surface 5. That is, the area in which the cutouts 25 are positioned collapses more easily than the surrounding area of the support surface 5, thus making the area with the cutouts 25 softer. The cutouts 25 reduce the peak pressures on the portion of the user's body (ideally the IT's) that is positioned over the cutouts 25. More specifically, the cutouts 25 and contoured top surface 10 reduce the peak pressures because the stiffness of the seat support surface 5 underneath bony prominences is strategically collapsed allowing a single density substrate to have varying stiffness values typically only found by adding a foam insert having a different (e.g., softer) density, a viscous or non-viscous gel insert, or an air-bladder insert into the cushion. The controlled structural collapse is built into a bottom surface 30 of the support structure 5, which enables the support structure 5 to look and feel like a prior cushion except for the reduction in peak pressures on the user. That is, the built-in structural collapse (cutouts 25) allows the cross-sectional stiffness to be changed in certain areas (e.g., in a portion of a certain cross-section) of the support surface 5 without making the cushion material softer or thicker in different areas.

Figure 2:
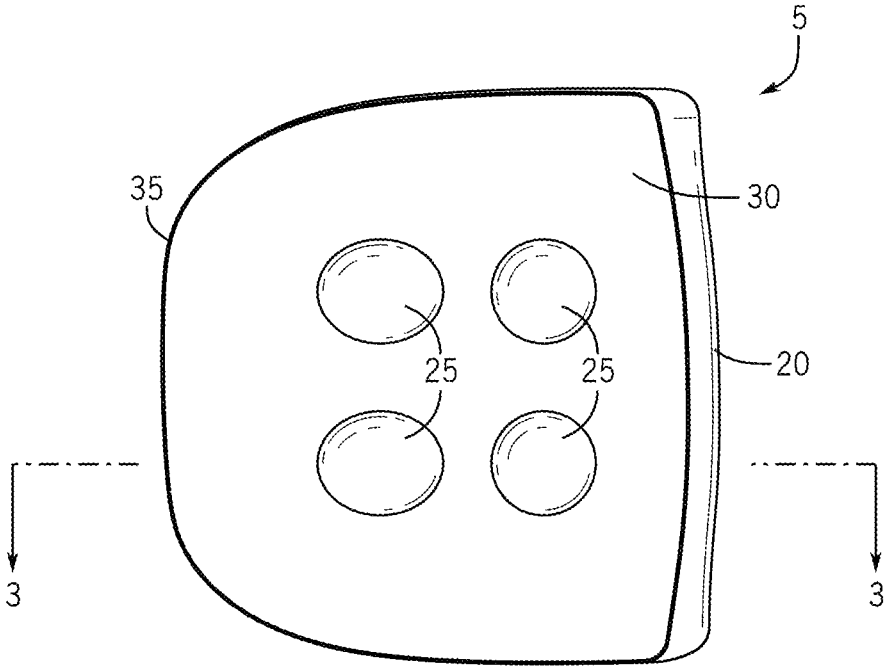
FIG. 2 depicts a bottom view of the seat support surface of FIG. 1.
Figure 3:
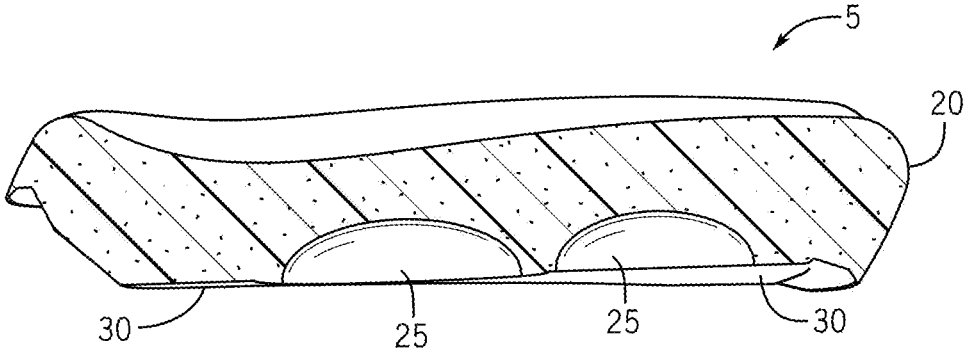
FIG. 3 is cross-sectional view of the seat support surface of FIG. 1.

FIGS. 2-7 show three examples of support surfaces 5 including cutouts 25, that are used to lower the peak pressures on the ischial tuberosities. FIG. 2 is a bottom view of the support surface and FIG. 3 is a cross-sectional view of the support surface 5 depicting the shape of the cutouts 25 (e.g., indents) on the bottom surface 30 of the support surface 5. The example cutouts 25 are substantially dome shaped or semispherical such that the top of the cutouts 25 is rounded but may be shaped in a different way (e.g., pyramidal, rectangular prisms, conical, etc.). For the figures, the cutouts 25 may have a circular or oval base shape, as shown in FIG. 2, and a semi-circular or semi-elliptical cross-section from a side view of the support surface, as shown in the cross-sectional view of FIG. 3. The cutouts 25 do not extend to the top surface 10 of the support surface 5, and thus the cutouts 25 are not open to the top surface 10 of the support surface 5. Because the cutouts 25 do not extend to the top surface 10 of the support surface 5, the user does not have the sensation of sitting on open holes when the user sits on the support surface 5.

In the illustrated example, the cutouts 25 are arranged in a first set positioned closer to a back edge 35 of the support surface 5 and a second set positioned closer to the front edge 20 of the support surface 5. The example first set is ideally positioned for a user who sits at the back of a seat or chair and uses a backrest of the seat or chair. The example second set is ideally positioned for when a user sits further forward near the front edge 20 of the seat support surface 5, i.e., in a perching position. Users may often prefer to sit further forward to, for example, relieve pressure on their legs from the support surface, better reach items on their desk or workspace, or for any other number of reasons or specific tasks. Both sets of cutouts 25 function similarly to provide the controlled structural collapse of the support surface 5 in a region adjacent to the user's ischial tuberosities. The cutouts 25, when the user is properly positioned on the support surface 5, are intended to reduce peak pressures typically seen with a prior single density material (e.g., a foam, gel, etc. material without cutouts).

Figure 4:
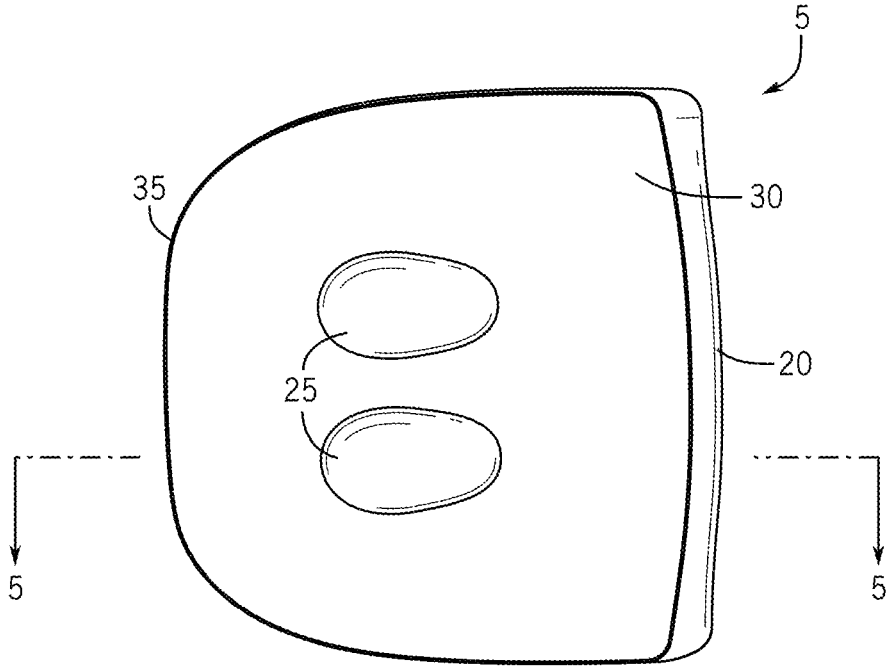
FIG. 4 depicts a bottom view of an alternative example seat support surface similar to the seat support surface of FIG. 1.
Figure 5:
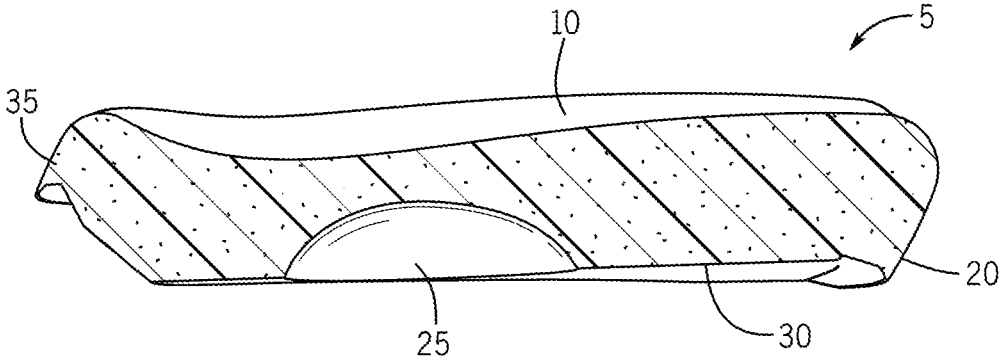
FIG. 5 is a cross-sectional view of the seat support surface of FIG. 4.

As shown in FIGS. 4 and 5, an alternative example support surface 5 may only include one set of cutouts 25 positioned adjacent the back edge 35 of the support surface. In some examples, the cutouts 25 in the support surface 5 of FIGS. 4 and 5 may be elongated (e.g., may have an oval or elliptical base shape extending further toward the front edge 20 of the support surface 5) to accommodate different sizes of users or different sitting positions of users. When a user sits only near the back of the support surface 5, the single set of cutouts 25 provides the same reduction in peak pressures on the ischial tuberosities as the example support surface 5 in FIGS. 2 and 3 having two sets of cutouts 25.

Figure 6:
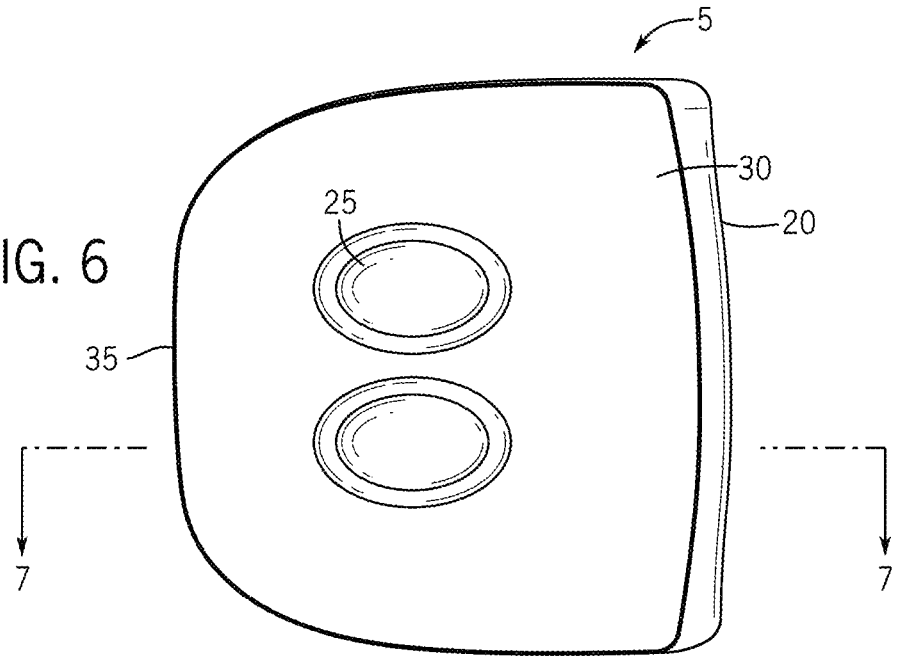
FIG. 6 is a bottom view of an alternative example seat support surface similar to the seat support surface of FIG. 1.
Figure 7:
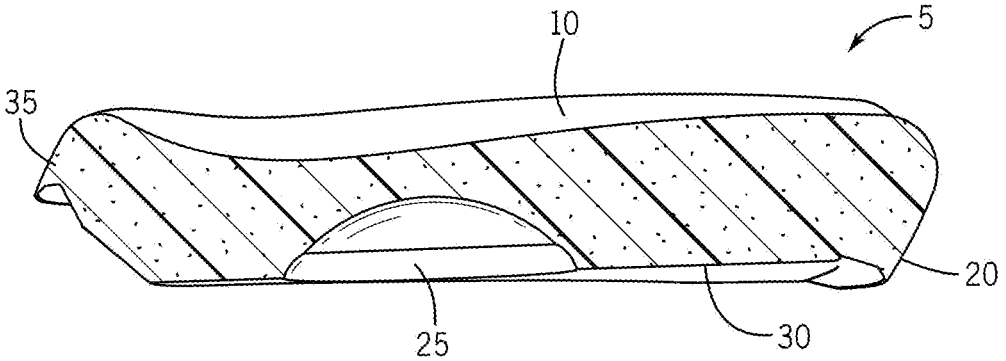
FIG. 7 is a cross-sectional view of the seat support surface of FIG. 6.

FIGS. 6 and 7 depict an example support surface 5 including alternative cutouts 25 positioned adjacent the back edge 35 of the support surface. In the example construction shown, the shape of the cutouts 25 may be described as a double dome shape or stacked dome shape. In the illustrated example, the cutouts 25 include a first dome and a second dome overlapping and/or stacked on one another. In the example construction shown in FIG. 7, the double dome shaped cutouts 25 include a first region or first dome extending into the support surface 5 to a first distance (e.g., depth) and a second region or second dome extending into the support surface 5 to a second distance. In at least one example, the first dome extends a greater distance into the support surface 5 than does the second dome. In the illustrated example, the first dome and the second dome of the cutouts 25 are aligned with one another. For example, a center point of the first dome and a center point of the second dome align with one another. In another example, the first dome may overlap with only a portion of the second dome. For example, a center point of the first dome and a center point of the second dome are displaced from one another. The stacked dome shape may additionally include rounded and/or straight edges.

When a user sits on the support surface 5, the set of cutouts 25 provides a similar reduction in peak pressures on the ischial tuberosities as the example support surface 5 in FIGS. 2-5. In the example construction in FIGS. 6 and 7, the first dome of the cutouts 25 is provided in a region adjacent to the user's ischial tuberosities and occupies an inner (or central) region of the cutouts 25. The second dome is provided in a region surrounding and proximate to the user's IT's, particularly surrounding (e.g., enveloping, overlapping, bordering, or encircling) the first dome and occupies an outer region of the cutouts 25. The double dome shape provides a greater reduction in peak pressures and a more precise controlled collapse of the support surface 5 under a user's ischial tuberosities due to the varying degree of cross-sectional stiffness. That is, when a user sits on the support surface 5, both the first dome and the second dome of the cutouts 25 function, individually and in tandem, to provide a form-fitting immersion of a user's bony prominences and tissue into the support surface 5. In one such example, the first dome is configured to provide a first cross-sectional stiffness and is further provided such that the inner region of the cutout 25 collapses under the users IT's. The second dome is configured to provide a second cross-sectional stiffness and is further provided such that the outer region of the cutout 25 collapses under the user's surrounding muscle and gluteal tissues, thus providing a controlled collapse of the support surface 5 which more closely matches the anatomy of a user. The stacked dome shaped cutouts 25 provide a varying cross-sectional stiffness in specific regions, particularly in the regions located under bony prominences, such as areas in which the ischial tuberosities or coccyx are placed.

Figure 8:
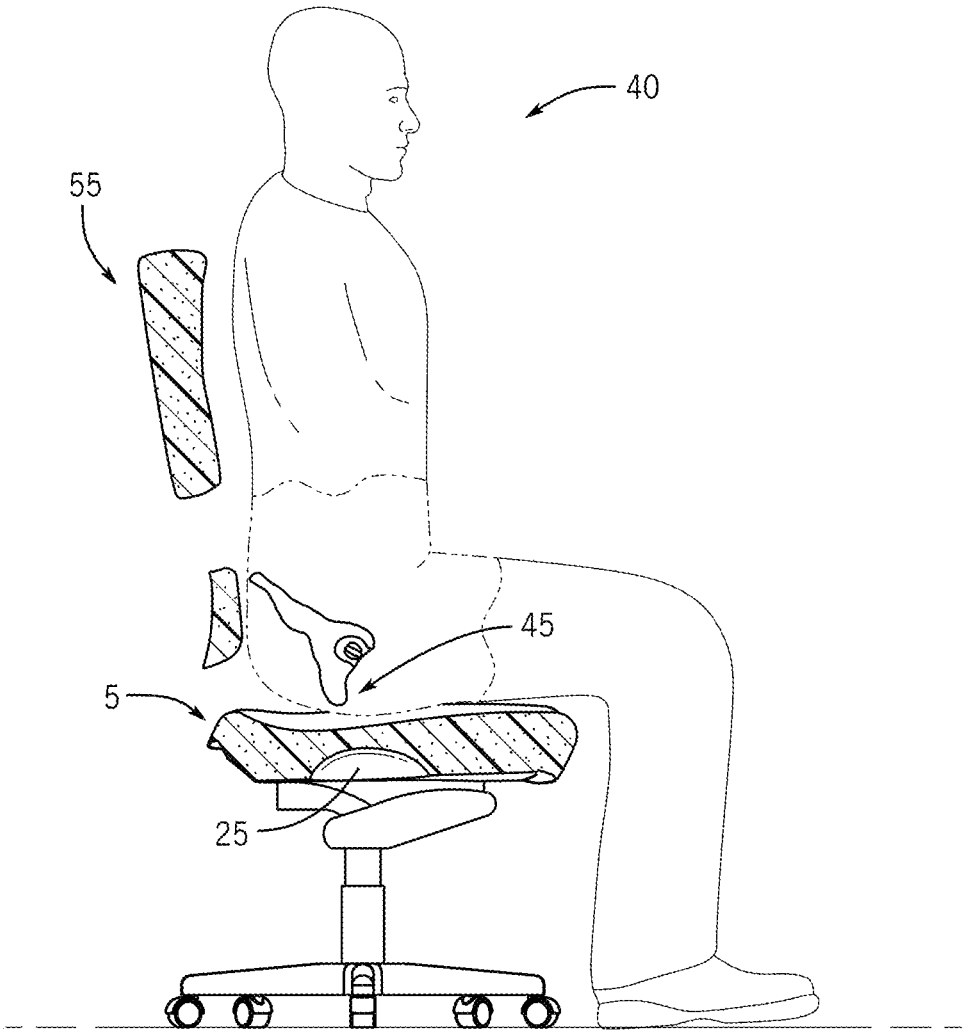
FIG. 8 depicts a cross-sectional view of an example user about to sit on a seat support surface similar to that described in FIGS. 1-5.
Figure 9:
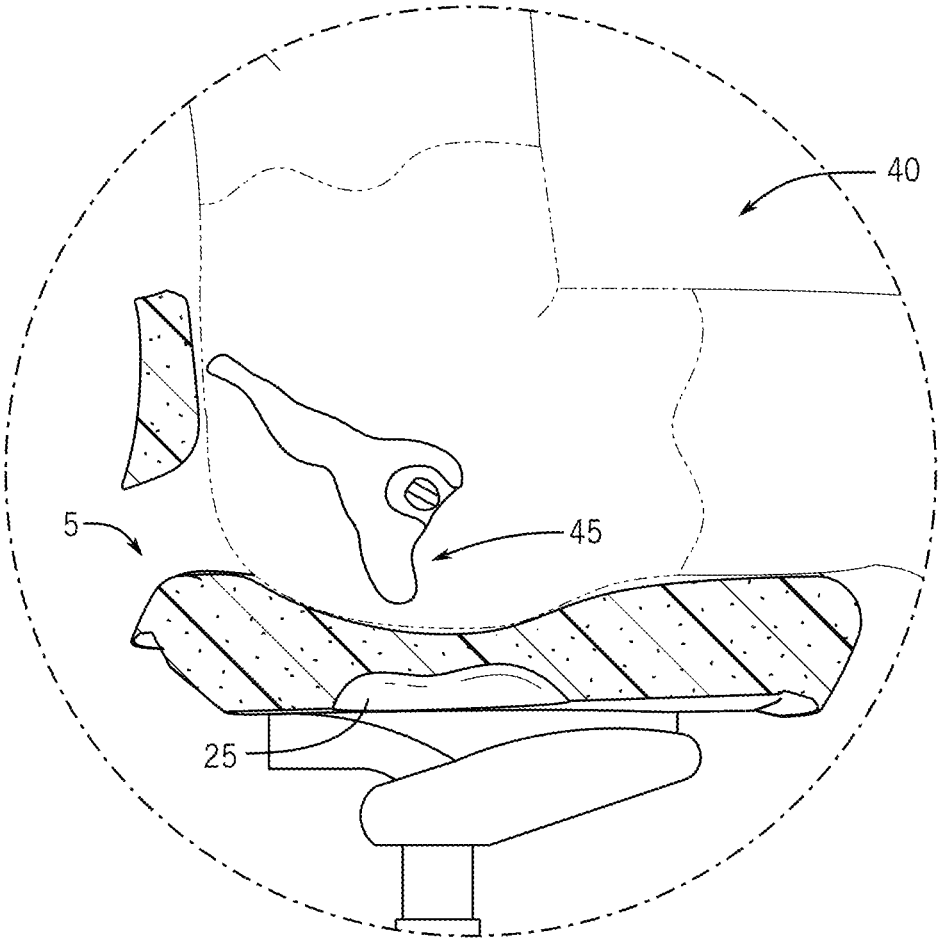
FIG. 9 depicts the example user sitting on the seat support surface of FIG. 8.

FIG. 8 depicts a cross-sectional view of an example user 40 about to sit on the support surface 5 (but not yet exerting a downward force on the support surface) and FIG. 9 depicts the example user 40 sitting on the support surface 5 that is similar to the support surface 5 of FIGS. 4 and 5. As shown in FIGS. 8 and 9, the cutouts 25 collapse (e.g., a controlled structural collapse), which allows the user 40 to sink further into the support surface 5 with less resistance from the material (e.g., foam) of the support surface 5 while simultaneously redistributing the user's seated pressures across the surrounding tissue areas, thus lowering the risk for a pressure injury and/or triggering the nociceptors around the ITs and surrounding region in the tissue. As the cutouts 25 collapse, the air is simply displaced from within the cutouts 25 and does not require any active means to remove the air from an air chamber formed by each cutout 25. The reduced stiffness of the support surface 5 in the ischial tuberosities region 45 results in the reduced pressure on the ischial tuberosities 45 of the user 40. Additionally, the user 40 is sitting deeper into the support surface 5, which helps cradle the pelvis of the user and provide a proper foundation for correct seated posture for the entirety of the spine. A proper foundation provides both lateral pelvic stability and the mitigation of forward travel, which often induces shear forces typically seen in surface and deep tissue. Shear forces are one of two ways that pressure injuries and nociception pain occur. Providing lateral stability and reducing forward shear is the foundation needed to then apply proper posterior input(s) through the pelvis and up to the cervical spine in an attempt to provide a correct seated posture for any individual.

While the example cutouts 25 depicted herein are dome-shaped or double-domed-shaped, other shapes of cutouts 25 may be used instead. The other shapes of cutouts 25 may include but are not limited to a flat-topped dome, a box, a pyramid, a flat-topped pyramid, rectangular prisms, conical, a flat-topped cone, a cylinder, a cylinder with rounded or tapered sides, combination thereof, or any other regular or non-regular geometric shape or multiple geometric shape or stacked geometric shape that provides a controlled collapse in an area of the support surface 5 near or at a user's ischial tuberosities 45 to reduce the peak pressures on the user's 40 ischial tuberosities 45 while not weakening the support surface 5 material to a point of failure over time. Some shapes (e.g., domes) are more conducive to the durability of the support surface 5. In some examples, the shapes that are more conducive to the durability of the support surface 5 may vary based on the density or type of the material used to construct the support surface 5. Furthermore, even though example support surfaces 5 are described herein with one or two sets of cutouts 25, additional sets may also be used in other support surfaces 5. For example, a larger support surface 5 may have more sets of cutouts 25 and/or each set of cutouts 25 may include more than two cutouts 25. In particular, a couch or bench support surface 5 may include multiple sets or zones of cutouts 25, where each set or zone of cutouts 25 includes two, four, six, or more cutouts 25; however, any suitable number of cutouts 25 is contemplated within this disclosure.

In some examples, an additional cutout 25 may be positioned in a region beneath the user's coccyx. In at least one such example, the cutout 25 is positioned in a region beneath the user's coccyx and is centered between and slightly behind the cutouts 25 for the IT's. The coccyx is also a high-risk area for pressure injuries when users 40 do not have the ability to sit pelvic neutral. The posterior collapse of their pelvis lowers the user's coccyx closer to the support surface 5 causing a peak pressure that can lead to a pressure injury. A strategic cutout 25 in this area could have the same effect in reducing the stiffness in a cross section of the support surface 5 to reduce the peak pressures in the coccyx region of the user 40.

In another particular example, a mattress (e.g., a foam mattress, a gel mattress) may have multiple sets of cutouts 25, where each set of cutouts 25 includes one or more cutouts 25. In the example mattress having cutouts 25, the sets of cutouts 25 may be organized into zones (e.g., a head zone, a torso zone, a hip zone, a leg zone) and the cutouts 25 in each zone may have different sizes and/or shapes to provide the best combination of support and decreased peak pressure for each zone. In another example, the zones of cutouts 25 are configured for back, stomach, and side sleeping, such that a user 40 may roll into or shift into various zones of cutouts 25.

Figure 10:
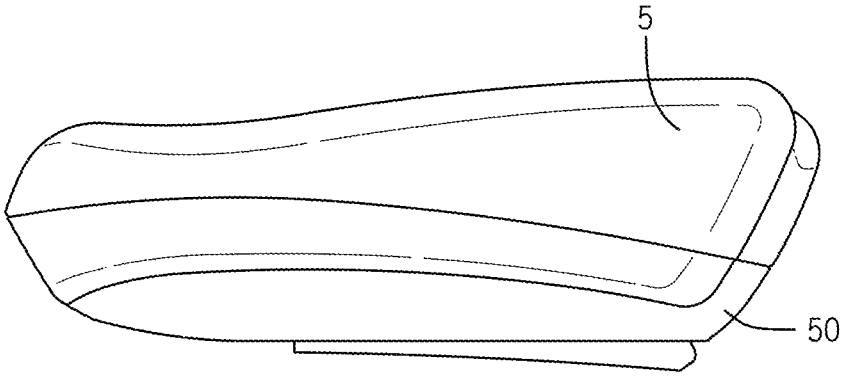
FIG. 10 depicts a perspective view of the support surface of FIGS. 1-7 in an example seat pan.
Figure 11:
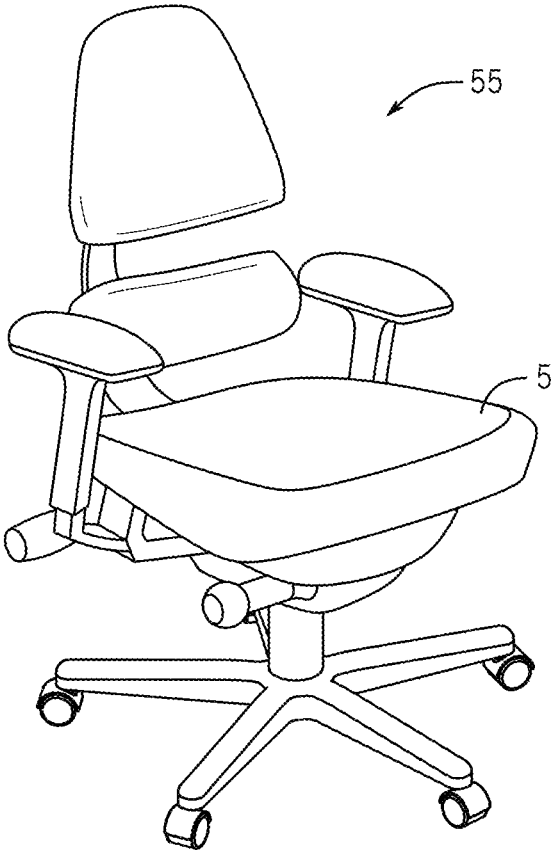
FIG. 11 depicts the support surface of FIGS. 1-7 in an example office chair including the seat pan of FIG. 10.

While a few particular alternative examples of support surfaces 5 or other uses for cutouts 25 on an underside of a seating or support surface 5 are mentioned above, the example cutouts 25 can be used in any seating surface or support surface including, but not limited to, vehicle seats, public transportation seats, stadium seating, theater seating, standalone cushions, seats in heavy machinery and tractors, seats on golf carts or other recreational vehicles, lawn care vehicles, office seating, home furniture, etc. In another particular example shown in FIGS. 10 and 11, the example support surface is placed in a seat pan 50 of an office chair 55. FIG. 10 depicts a side view of the support surface 5 in the seat pan 50 and FIG. 11 depicts the example office chair 55 with which the support surface 5 may be used.

Figure 12:
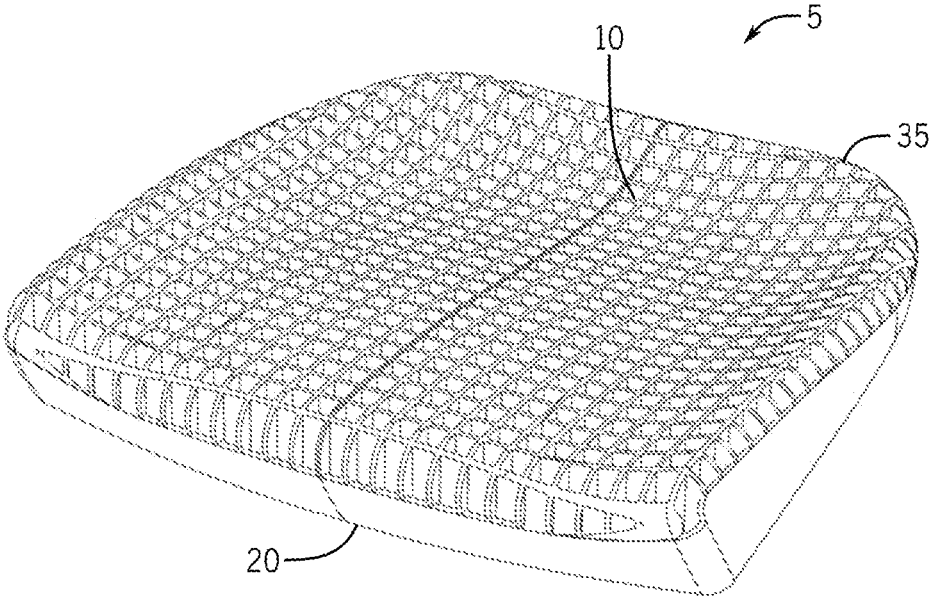
FIG. 12 depicts an alternative version of the support surface of FIGS. 1-7 made of a gel material.

Additionally or alternatively, other materials may be used for the example support surface 5. In one particular example shown in FIG. 12, a solid-state gel may be used. The solid-state gel can be manufactured to have a similar stiffness and may yield similar sitting characteristics as a foam support surface 5. Each different material that may be used for the example seat support surface may have cutouts 25 that are slightly different in size. However, the location of the cutouts 25 under the IT's is consistent. Specifically, the solid-state gel may be poured into a mold or injection molded into the finished shape, including the cutouts or domes 25 described herein. In the example support surface of FIG. 12, the support surface 5 may be molded to include a lattice-like or honeycomb-like structure, as shown on the top surface 10, which provides a first cross-sectional stiffness. Similar to a prior foam cushion, a support surface manufactured from solid-state gel may be provided with the example cutouts 25 to vary the cross-sectional stiffness in regions beneath a user's bony prominences.

Figure 13:
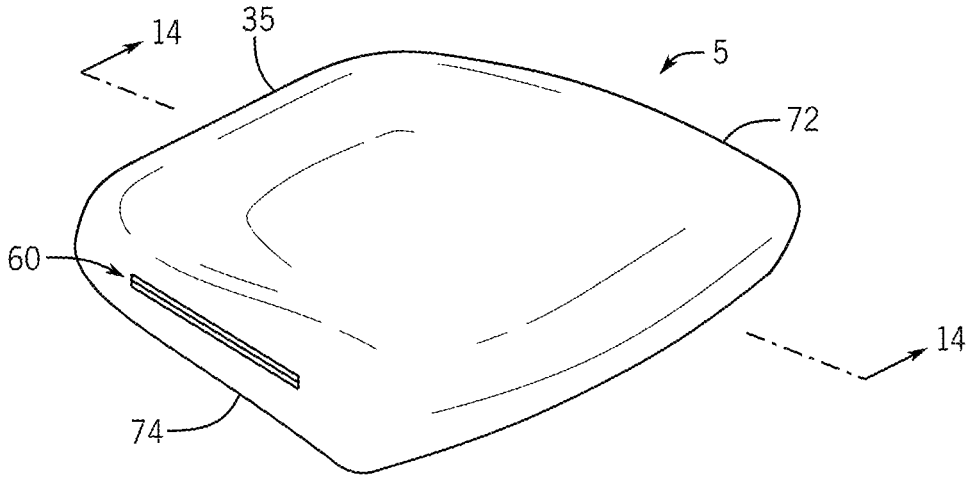
FIG. 13 depicts a perspective view of an example support surface including a shear reduction feature.
Figure 14:
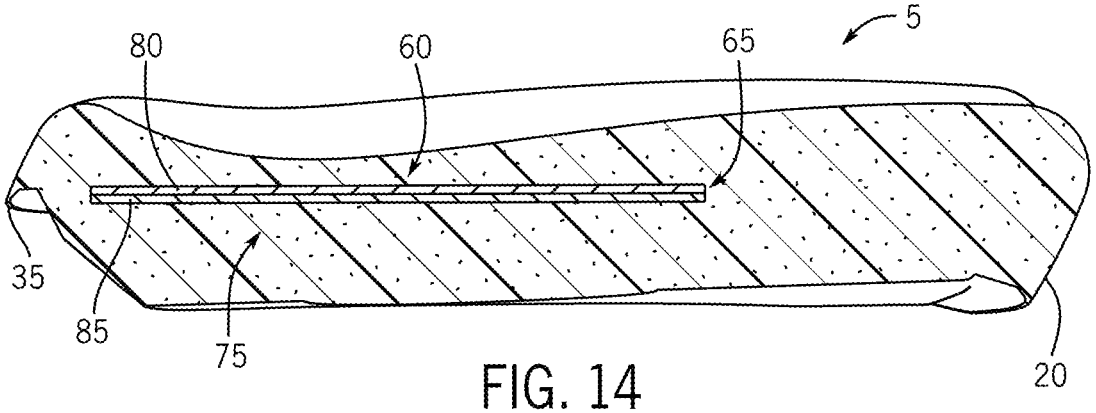
FIG. 14 depicts a cross-sectional side view of the support surface of FIG. 13.

FIGS. 13 and 14 depict a perspective view and a cross-sectional side view of an example seat support surface 5 including a shear reduction feature 60. The example shear reduction feature may include a cut 65 (e.g., an aperture, a hole, a slot, a slit) positioned adjacent to, but spaced from, a rear edge 35 of the support surface 5 and a low-friction or slippery material 75 (e.g., a material having a low coefficient of friction or low COF). The example cut 65 extends across the width of the support surface 5 (e.g., from a left side edge 72 to a right side edge 74). In the illustrated example, the cut 65 extends in a horizontal plane and is substantially parallel to a bottom surface 30 of the support surface 5. The cut 65 may alternatively extend in a plane substantially parallel to the inclined femoral surface. When viewed in the sagittal plane, a cross-section of the cut 65 described herein is straight. The cut 65, however, may be any suitable shape and may additionally or alternatively include, for example, a curve or bend. In one such example, the cut 65 may be curved such that a cross-section of the cut 65 mimics or follows the contour of the pelvic well and inclined femoral surface.

In the figures, the example cut 65 includes a first surface 80 and a second surface 85 opposite the first surface 80. Each of the first and second surfaces 80, 85 includes the low-friction material 75 (e.g., lycra, silicone coated nylon (ripstop), etc.). The low-friction material 75 is preferably a fabric having a low COF and specifically a fabric with anisotropic characteristics. That is, the low-friction material or fabric 75 is manufactured (woven, stitched, or knit) such that the fibers or fiber pattern run length-wise on a first side or face and cross-wise on a second side (e.g., perpendicular to one another). The low-friction fabric 75 is a close-knit fabric comprising fine ribs (a ribbed pattern), such as a lycra spandex knit. A first/primary face or principal side of the low-friction fabric 75 including the fine ribs can be referred to as the low-friction side and may have a shiny hue. The second side of the low friction fabric comprises ribs, or stitch direction, running perpendicular to those of the low-friction side and may exhibit a dull or matte finish. In at least one example construction, the low-friction material 75 may stretch or expand in all directions (e.g., length and width). In the example construction shown, the first and second surfaces 80, 85 are provided with the low-friction fabric. When interfaced together, the low-friction fabric exhibits a low coefficient of friction. Particularly, the low-friction and/or shiny sides of the low-friction fabric 75 are placed face-to-face such that fiber or rib directions (e.g., weave or knit directions) run perpendicular to one another, thus creating a smooth and/or low-friction interface between surfaces 80, 85 due to the minimization of surface area contact between the first and second surfaces 80, 85. While a perpendicular orientation is preferred, the low-friction fabric 75 need not be arranged precisely such.

As a user sits on the support surface 5 in the area above the shear reduction feature 60, the low-friction material 75, and consequently the two surfaces 80, 85 of the cut 65, are able to move relative to one another with very little friction. Thus, a multi-directional (e.g., up/down, side-to-side, front/back) shear stress or shear force underneath bony prominences is reduced when compared to a traditional cushion. Reducing shear stress in the seated plane results in increased comfort for the user. Specifically, reducing shear stress and increasing immersion in a seated plane reduces the triggering response of mechanoreceptors, known as Ruffini corpuscles, which respond negatively to stretch and shear stresses.

The cut 65 of the example support surface 5 may be formed at the time the support surface 5 is made. In some examples, a mold for the support surface 5 includes a plate at the location of the cut and the foam is poured in the mold (and thus, around the plate). The low-friction material 75 is wrapped around the plate during this process prior to pouring the foam. When the foam is removed from the mold, the plate is removed from the support surface, leaving the cut 65 and the low-friction material 75 within the cut on surfaces 80, 85. Alternatively, the cut 65 may be cut through the support surface 5 after the support surface 5 is removed from a mold and the low-friction material 75 is inserted using a plate corresponding to the shape/size of the cut 65. In yet another alternative example, a cut may be made from a rear edge 35 of the support surface 5 extending into the support surface 5 the desired distance. The flattened tube of low-friction material 75 is then placed within the cut. Rear edges of each surface of the cut may be attached to one another (e.g., using an adhesive, or other mechanical fastener).

In another particular example, the support surface 5 may include an alternative shear reduction feature 60 having a cutout or slot adjacent to but spaced from the rear edge 35 of the support surface 5. In one such example, the support surface 5 may include an upper portion having a first primary surface (interface) 80 and a lower portion separate from the upper portion having a second primary surface or interface 85 configured opposite the first interface 80. That is, the support surface 5 may be two separate pieces, the lower portion having the cutout and the upper portion configured to fill the cutout such that the first and second primary surfaces 80, 85 are proximate one another, thus forming an interface (similar to the cut 65) within the support surface 5. Congruent to the cut 65 depicted in FIGS. 13 and 14, the cutout or slot extends from the left side edge 72 to the right side edge 74. The first and second surfaces of the cutout or slot further include the low-friction fabric 75. In other words, the low-friction material is provided on adjacent (primary) surfaces 80, 85 between the upper portion and lower portion of the support surface 5. As with the cut 65 depicted in FIG. 13, the cutout or slot enables the first and second surfaces of the slot to move relative to one another with very little friction, thus reducing shear stress when a user sits on the support surface 5. In at least one example construction, the first and second surfaces of the cutout extend in a horizontal plane substantially parallel to a bottom surface 30 of the support surface 5. In another example, the cutout may alternatively extend in a plane substantially parallel to the inclined femoral surface. When viewed in the sagittal plane, a cross-section of the cutout described herein is straight. However, the cutout (and thus the respective shapes of the upper and lower portions) may be any suitable shape such that first and second primary surfaces 80, 85 (corresponding to the upper and lower portions of the support surface 5) create a low-friction interface under the user's bony prominences. For example, the first and second primary surfaces 80, 85 of the cutout or slot may be rectangular, circular, or any suitable shape. A cross-section of the cutout or slot may additionally or alternatively include, for example, a curve or bend. In one such example, the cutout may be curved such that a cross-section of the cutout mimics or follows the contour of the pelvic well and inclined femoral surface.

Similar to the formation of the cut 65, the cutout of the example support surface 5 may be formed at the time the support surface 5 is made. In some examples, a mold for the support surface 5 includes a plate at the location of the cutout or slot and the foam is poured in the mold (and thus, around the plate). The low-friction material 75 is wrapped around the plate during this process. When the foam is removed from the mold, the plate is removed from the support surface 5, leaving the cut and the low-friction material 75 within the cut on surfaces. Alternatively, the slot may be cut through the support surface after the support surface 5 is removed from a mold (e.g., a slot is made from the left side edge 72 to the right side edge 74) and the low-friction material 75 is placed on each surface of the cut and attached (e.g., using an adhesive).

Figure 15:
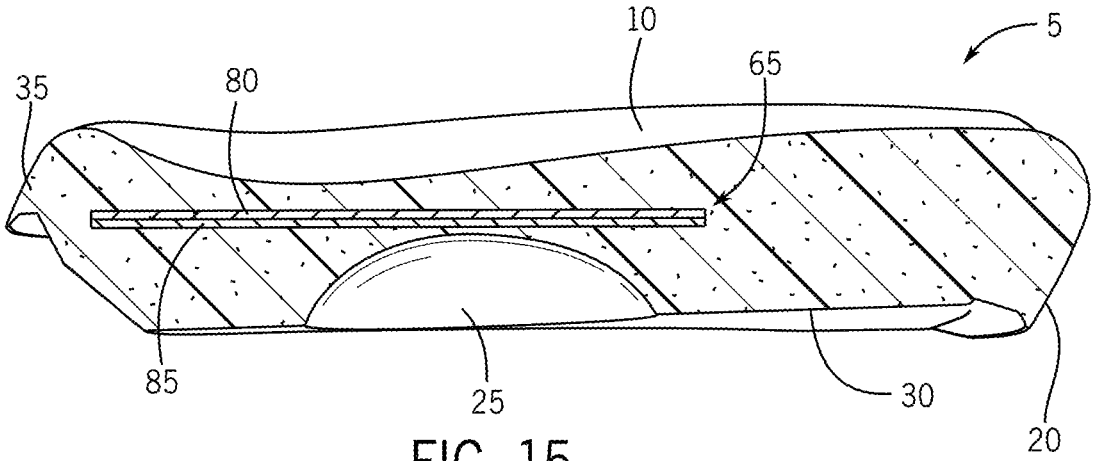
FIG. 15 depicts a cross-sectional side view of an example support surface including the shear reduction feature of FIG. 13 and pressure reduction features described in conjunction with FIGS. 4 and 5.
Figure 16:
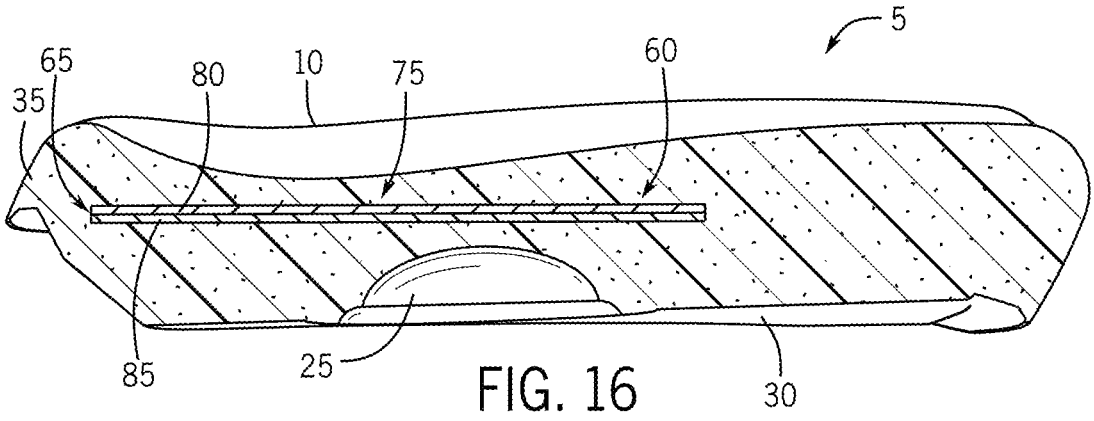
FIG. 16 depicts a cross-sectional side view of an example support surface including the shear reduction feature of FIG. 13 and pressure reduction features described in conjunction with FIGS. 6 and 7.

While the example support surface 5 shown in FIGS. 13 and 14 only includes a shear reduction feature 60, the support surface may, additionally or alternatively, include the pressure reduction features described in conjunction with FIGS. 1-7. Example support surfaces 5 having the aforementioned pressure reduction features 25 and a shear reduction feature 60 are shown in FIGS. 15 and 16. In the illustrated construction in FIG. 15, the example support surface 5 includes one set of cutouts 25, similar to the example support surface depicted in FIGS. 4 and 5. The set of cutouts 25 is positioned adjacent the back edge 35 of the support surface and below the shear reduction feature 60; however, the location of the cutouts 25 under the IT's is consistent. In some examples, the cutouts 25 in the support surface 5 may be elongated (e.g., may have an oval or elliptical base shape extending further toward the front edge 20 of the support surface 5) to accommodate different sizes of users or different sitting positions of users. As shown in FIG. 16, the example support surface 5 may include the shear reduction feature 60 and a set of cutouts 25 having a double dome shape. While depicted in a horizontal plane, the shear reduction feature 60 of FIGS. 15 and 16 may, in alternative examples, extend through the support surface in any suitable plane or at any suitable angle such that the shear reduction feature 60, or a portion thereof, lies between a top surface 10 of the support surface 5 and the cutouts 25.

Figure 17:
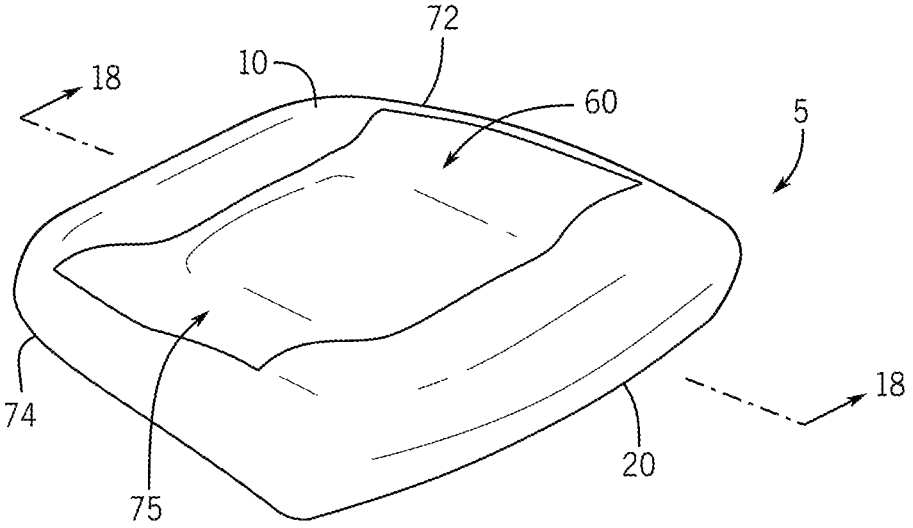
FIG. 17 depicts a perspective view of an example support surface including an alternative shear reduction feature.

In another particular example, the example support surface 5 may include a shear reduction feature 60 on a top surface 10 of the support surface 5. FIG. 17 depicts an example support surface 5 including an alternative shear reduction feature 60. In the example construction shown, the shear reduction feature 60 or low-friction interface is substantially rectangular and is provided on a top surface 10 adjacent to but spaced from a rear edge 35 of the support surface 5 and extends from a left edge 72 to a right edge 74. However, the shear reduction feature 60 may be any suitable shape. The shear reduction feature 60 is provided in a region on the support surface 5 under a user's bony prominences, particularly under a user's ischial tuberosities. In the example shown, the shear reduction feature includes a first interface 85 of low-friction material 75 provided proximate a top surface 10 of the support surface 5 and a second interface 80 of low-friction material 75 provided opposite the first interface 85. In at least one example construction, the low-friction material is a close-knit fabric having a first fiber or rib direction on a first side and a second fiber or rib direction running perpendicular to the first fiber direction on a second side. In the illustrated example in FIGS. 17 and 18 the first and second interfaces 80, 85 of the low-friction material 75 are oriented such that the low-friction sides of the first and second interfaces 80, 85 are face-to-face and arranged such that the rib directions are perpendicular to one another, thus creating a low-friction interface on the top surface 10 of the support surface 5.

Figure 18:
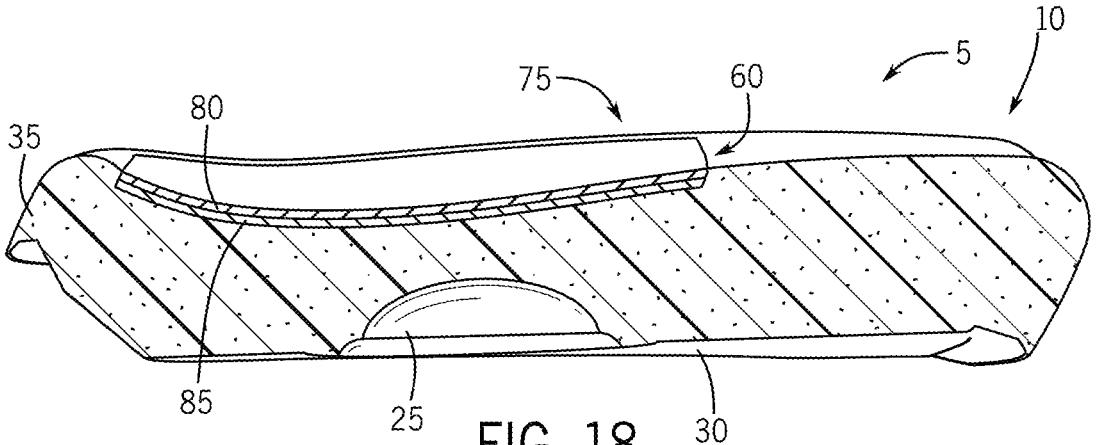
FIG. 18 depicts a cross-sectional side view of an example support surface including the shear reduction feature of FIG. 17 and pressure reduction features described in conjunction with FIGS. 6 and 7.
Figure 19:
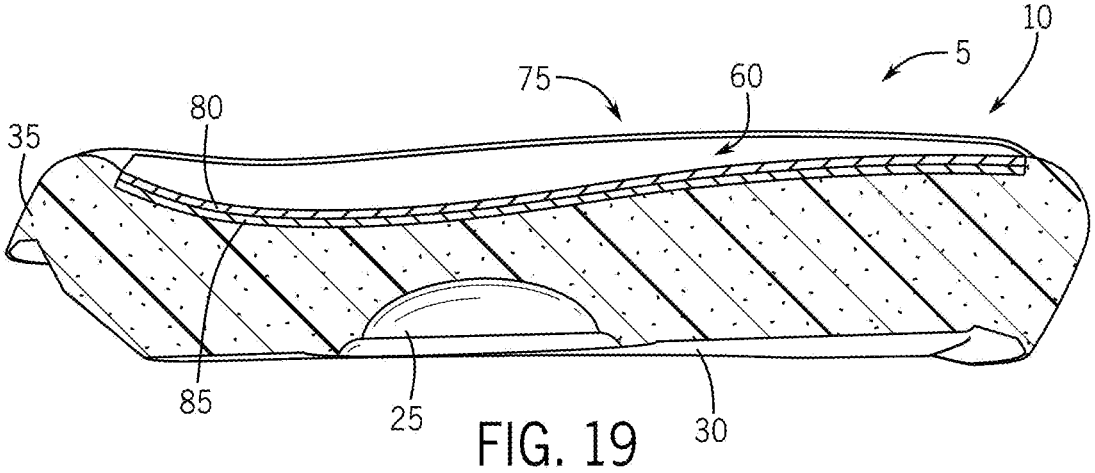
FIG. 19 depicts a cross-sectional side view of an example support surface including an alternative shear reduction feature and pressure reduction features described in conjunction with FIGS. 6 and 7.

In the example shown in FIGS. 17 and 18, the shear reduction feature 60 is provided in a region adjacent a rear edge 35 of the support surface 5, however, the shear reduction feature may also be provided across the entire top surface 10. FIG. 19 depicts an example support surface 5 including an alternative shear reduction feature 60. In the example construction shown, the shear reduction feature 60 or low-friction interface is provided across and or on top of a top surface 10 of the support surface 5. In the depicted construction, the shear reduction feature includes a first interface 85 of low-friction material 75 provided proximate a top surface 10 of the support surface 5 and a second interface 80 of low-friction material 75 provided opposite the first interface 85. Consistent with the example constructions discussed herein, the low-friction material 75 is preferably a fabric having a low COF and specifically a fabric with anisotropic characteristics. When interfaced together, the low-friction fabric exhibits a low coefficient of friction. Particularly, the shiny sides of the low-friction fabric are placed face-to-face such that fiber or rib directions (e.g., weave or knit directions) run perpendicular to one another, thus creating a smooth and/or low-friction interface between surfaces 80, 85.

The shear reduction feature 60 may, in some examples, be provided in the form of a casing (e.g., wrap, pouch, tube) having a first interface 85 and a second interface 80 of low-friction material 75 opposite the first interface. In at least one such example construction, the shear reduction feature 60 may envelope the support surface 5; in other examples, the shear reduction feature 60 may encase only a portion of the support surface 5. The casing or pouch of low friction material 75 may have an open end and a closed end. For ease of manufacturing, the casing may cover the entire support surface 5. Specifically, the open end of the casing may slide on (or envelope over) a front edge 20 of the support surface 5 and fasten on a rear edge 35 using any suitable upholstery method. In another example, the shear reduction feature 60 may include a single interface of low-friction material 75.

The example support surface(s) 5 described in conjunction with FIGS. 13-19 may further include a cover (e.g., a seat cushion cover, an upholstery cover and/or fabric cover) provided over and/or on top of the shear reduction feature 60. In at least one construction, the shear reduction feature 60 may be sewn into the upholstery cover such that shear reduction feature sits proximate a top surface 10 of the support surface 5, thus separating the support surface 5 from a bottom surface of the upholstery cover. When a user sits on a support surface having only a traditional upholstery cover, shear strain is induced on the user's tissues (Ruffini corpuscles) in regions where the upholstery cover and the support surface exhibit a high COF (e.g., under a user's bony prominences), thus causing the upholstery cover to bite and thereby preventing the user from freely immersing into the support surface. By implementing a low-friction interface (shear reduction feature 60) between the support surface 5 and the underside of the upholstery cover, the frictional barrier can be separated, allowing a user to immerse into and/or adjust position in the support surface without inducing shear strain across a plane of the support surface. In other examples, the shear reduction feature 60 may be fastened another way (e.g., staples, rivets, or any suitable upholstery method), however, the location of the shear reduction feature 60 on top of the support surface 5 and below the upholstery cover is consistent. Additionally or alternatively, the shear reduction feature 60 may be fastened to both the support surface 5 and an upholstery cover; however, the location of the low-friction interface (shear reduction feature 60) between the support surface 5 and the upholstery cover is consistent. In other words, the shear reduction feature 60 is provided proximate to a (top) surface of the support surface 5 and is further provided adjacent to but separate from a user's tissue, the upholstery cover separating the shear reduction feature 60 from the user.

Any of the example shear reduction features 60 described herein may be used with the pressure reduction feature 25 described in conjunction with FIGS. 1-11 above. Using both a shear reduction feature 60 and a pressure reduction feature 25 may be desirable to produce a more immersive and therefore comfortable sitting surface for a user. Specifically, the shear reduction feature 60 and the pressure reduction feature 25 function, individually and in tandem, to provide a form-fitting immersion into the support surface 5, thus reducing peak pressures and shear strain acting on a user while seated. For example, the structure of the pressure reduction feature 25 functions to receive the shape of the user, and particularly, provides a controlled collapse of the support surface 5 thereby reducing peak pressures on a user's IT's. The shear reduction feature 60 functions to allow a user to smoothly or freely immerse and/or sink into the support surface 5 whilst preventing the user's body from catching or biting into the support surface 5 (e.g., preventing the user's body from experiencing shear pressure or shear strain across a support surface plane). Contrariwise, a support surface having only a traditional upholstery cover would induce shear pressure and shear strain on a user while sitting due to the frictional interface between the support surface and the upholstery cover. When a user sits on a support surface having a traditional upholstery cover, shear strain is induced on the user's tissues (Ruffini corpuscles) in regions where the upholstery cover and the support surface exhibit a high COF (e.g., preventing the user from freely immersing into the support surface). By implementing a low-friction interface between the support surface and the upholstery cover, the frictional barrier can be separated, thereby allowing a user to immerse into and/or adjust position in the support surface without inducing shear across a plane of the support surface. While both the pressure reduction feature 25 and the shear reduction feature 60 are described in conjunction with a seat support surface, the respective features 25, 60 may also be implemented across all support surfaces in, for example, a task chair, a mattress, or any suitable support surface beneath a bony prominence, such as, for example a lateral, inferior, medial, anterior, or posterior support surface. That is, the pressure reduction feature 25 and the shear reduction feature 60 may promote proper immersion for support surfaces collapsing in the coronal (front), transverse (top), and sagittal (side) planes respectively.

By using shear reduction and/or peak pressure reduction, the example seat support surface 5 reduces the activation amount and/or intensity of the mechanoreceptors related to pressure (Merkel discs) and shear strain (Ruffini corpuscles). Reducing the activation of the mechanoreceptors results in less perceived discomfort by the user, allowing the user to have greater comfort over the duration of sitting on the example seat support surface 5.

Figure 20:
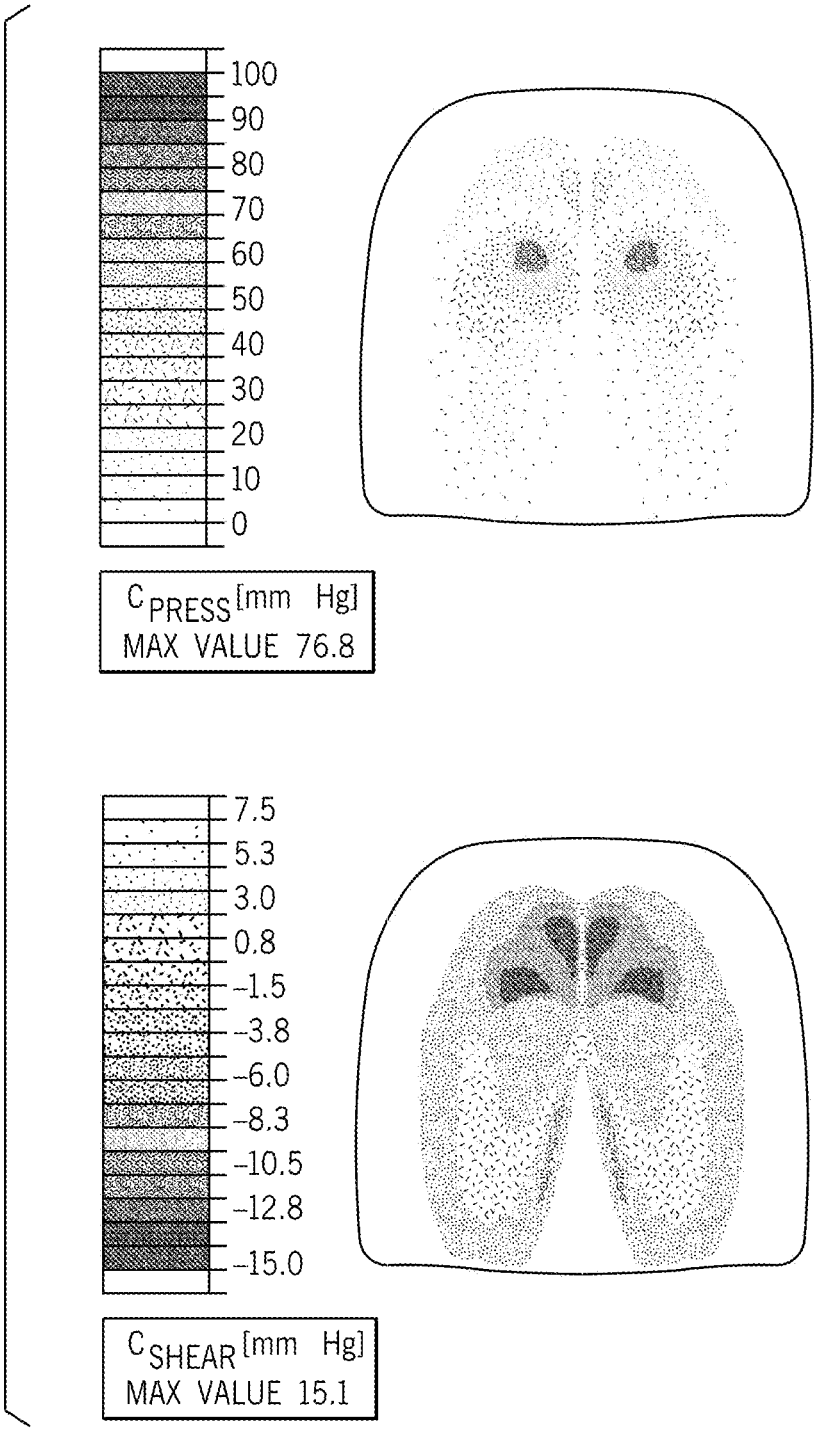
FIG. 20 depicts example interface mapping for pressure and shear conducted using a support surface similar to the support surface of FIG. 19.
Figure 21:
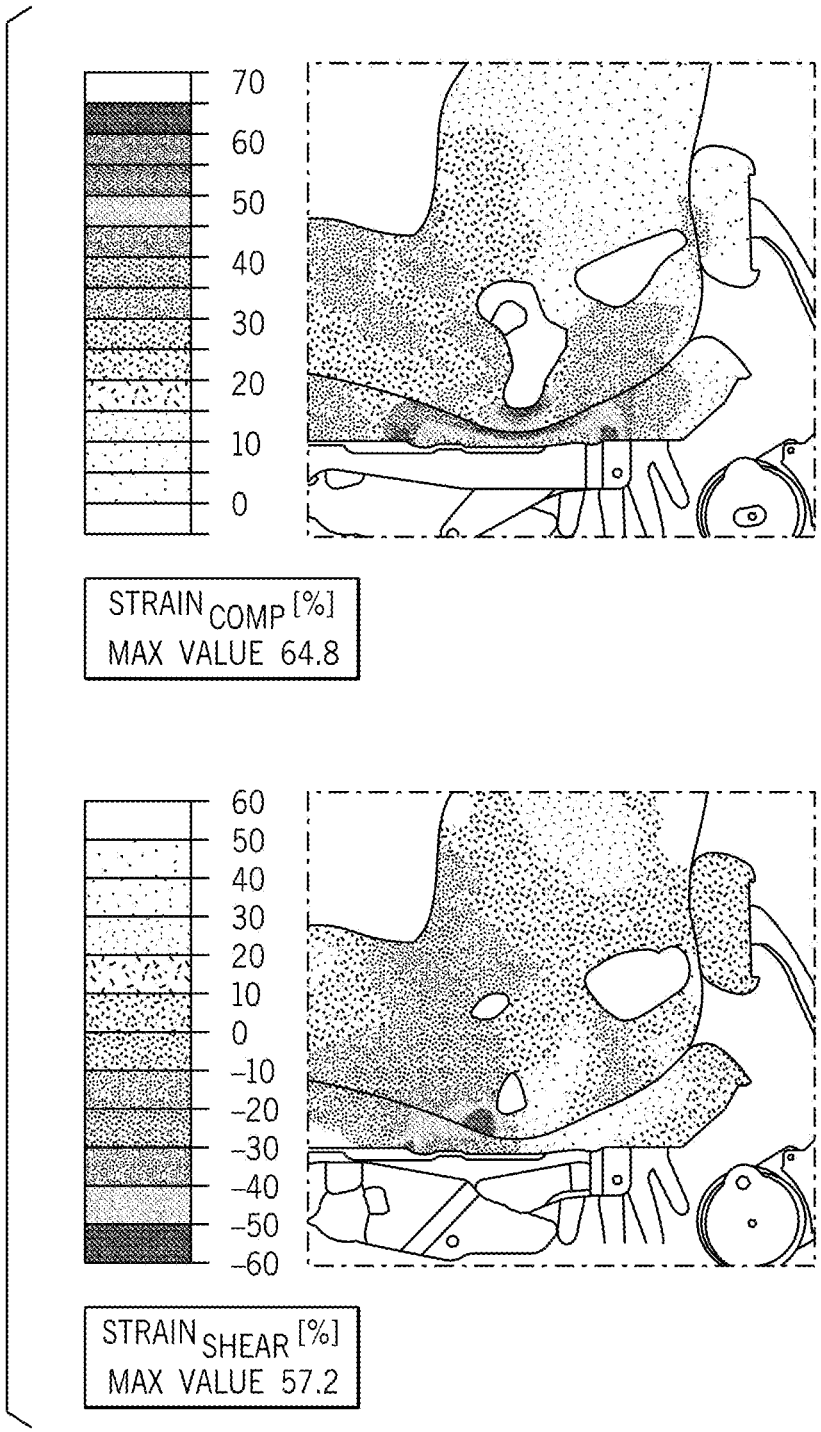
FIG. 21 depicts example volumetric strain distributions of compressive tissue strain and shear tissue strain on a user sitting in a support surface similar to the support surface of FIG. 19.

An initial analysis was performed to assess the immersion and performance characteristics of the example support surface 5 and specifically the pressure reduction feature 25. The kinematic study consisted of subjecting the support surface to an average simulated load (e.g., a user having a height of 1.80 meters and a weight of 78 kilograms) at an upright position and tilting the support surface in space from the upright position to a first position or tilted posture of six degrees and a second position or tilted posture of twelve degrees. Sensors located across the seating plane of the support surface were used to measure maximum values for compressive pressure and compressive shear as well as maximum values for compressive strain and shear strain. Dispersion mapping across the seating plane of the support surface 5 was conducted. FIG. 20 depicts example resulting pressure maps and shear maps recorded for the support surface 5. Points of tissue strain, for example, below a user's ischial tuberosities, were quantified using a Volumetric Strain Distribution (VSD). FIG. 21 shows example distributions of compressive and shear strain observed during the study. The results are recorded in Table 1 below.

TABLE 1

Interface pressure and tissue strain analysis.

| Variation | Posture | $Pressure_{Compressive}$ [mm HG] | $Shear_{Compressive}$ [mm HG] | $Strain_{Compressive}$ [%] | $Strain_{Shear}$ [%] |
|---|---|---|---|---|---|
| Support Surface described in FIGS. 4 and 5 | Upright | 80.8 | 15.2 | 65.3 | 56.7 |
| | Tilt 6° | 72.9 | 15.2 | 64.1 | 57.9 |
| | Tilt 12° | 62.9 | 13.6 | 62.1 | 59.8 |
| Support Surface described in FIGS. 6 and 7 | Upright | 76.8 | 15.1 | 64.8 | 55.6 |
| | Tilt 6° | 69.2 | 15.1 | 63.5 | 56.7 |
| | Tilt 12° | 60.2 | 13.5 | 61.6 | 58.7 |

The average seating surface, such as, for example a mesh seating surface, typically induces peak compressive pressures of around 152 mm HG on the tissues of a user and does not provide for an immersive support surface. In the example study, various implementations of the support surface 5 were successful in reducing peak pressures by over 60 mm HG. Specifically, the peak compressive pressure, in at least one variation, was lowered to a value of 77 mm Hg while configured in an upright position using the support surface 5 with the cutouts 25 as described herein. A further reduction in peak pressures was observed when the user was seated in a tilted posture. In the tilted position, the example support surface 5 works in conjunction with support surfaces adjacent the lumbar and thoracic regions to cradle the pelvis of the user and provide a proper foundation for correct seated posture for the entirety of the spine.

In addition to reducing peak pressures, the results of the study further evidenced the ability of the cutouts 25 to successfully reduce compressive shear, thereby lessening tissue strain experienced by the user. Referencing FIG. 9, when a user 40 sits on the support surface 5, the cutouts 25 collapse under the user's bony prominences. While in the example shown, the cutouts 25 collapse in a vertical plane or dimension; the cutouts may, in some examples, collapse three-dimensionally (including torsional and translational deformation). In the trials, the cutouts 25 demonstrated non-uniform collapsing which varied between the three seated postures. The support surface 5 having stacked dome shaped cutouts 25 showed a slight improvement across every metric recorded. The study demonstrated that the varying degree of cross-sectional stiffness created by the cutouts 25 provided a non-uniform controlled-collapse, thereby allowing the cutouts to deform in a way such that tension within the support surface 5 is lessened, which in turn reduced tissue strain experienced by the user 40.

A second series of kinematic studies was performed to assess the performance and immersion characteristics of the example support surface 5 as compared to competitor support surfaces. In each example, the series of studies was conducted using three variations of the seating support surface 5, each including the pressure reduction feature 25. A first variation of the support surface 5 included the shear reduction feature 60 and a prior upholstery cover, a second variation of the support surface 5 included only a prior upholstery cover, and a third variation of the support surface 5 was tested without any upholstery cover.

Published technical standards for seat cushions (support surfaces) provide standardized terminology and methods for characterizing performance. Ten ISO 16840 seating standards have been published, these voluntary standards provide information that can be used by manufacturers to assess and benchmark their products, by consumers and clinicians to compare and select products, and by regulators, purchasers and third-party payers in regulatory and purchasing policies. These standards were modified and applied to the example support surface 5 and competitor support surfaces. The results of four example studies conducted under ISO 16840 are depicted in TABLES 2-6 and FIG. 22 and are further described herein.

Example 1

Proper immersion and cradling of a user's pelvis and buttocks significantly help reduce tissue strain in areas adjacent to bony prominences. A number of standardized tests can be used to demonstrate the effects of the pressure reduction and shear reduction features 25, 60 used both individually and in conjunction relative to the degree of immersion into the support surface and the stability of the support surface under a live load. ISO 16840-2 provides guidance in determining physical and mechanical characteristics of support surfaces intended to manage tissue integrity and should be referenced for more information on the procedures described in conjunction with the study performed in Example 1.

A loaded contour depth and overload deflection test was performed (following ISO 16840-2:2018, Clause 11) to evaluate the support surface's ability to properly immerse the user. Immersion is defined as the depth to which a person sinks into the cushion (support surface). Cushions with higher additional immersion under the overload conditions have higher margins of safety against bottoming out (i.e., higher margins of safety against creating peak pressures). The following procedure was followed:

1) A nominal load of 135N is applied to the cushion for 300 seconds;
2) An overload 33% greater than the nominal load is applied to the cushion for 60 seconds and additional immersion is measured as Overload Deflection 1 (mm); and
3) An additional overload 66% greater than the nominal load is applied to the cushion for 60 seconds and additional immersion is measured as Overload Deflection 2 (mm).

Loaded contour depth and overload deflection methods are used for verification for CMS coding. CMS differs from the ISO loaded contour depth for the General Use cushions, which are tested with a 25-mm cushion loading indenter (CLI) at a nominal load of 140N and overload of 187N. Skin Protection cushions are tested with the ISO 40-mm cushion loading indenter. According to the requirements set forth by the CMS Wheelchair Seating-Policy Article (A52505), a cushion (support surface) passes testing if there is contact between the trochanter buttons of the cushion loading indenter and the cushion for all three trials of loaded contour depth testing and exhibits a median Overload Deflection 1 of greater than or equal to 5 mm when rounded to the nearest 5 mm. A cushion should pass this testing before (pre) and after (post) simulated aging procedures to meet official coding verification requirements.

Each support surface was tested according to the ISO test method using a 40-mm indenter and tested using the CMS PDAC test method using a 25-mm indenter. Three key outcomes were assessed: Trochanter contact at the nominal load, Overload Deflection 1 and Overload Deflection 2. Contact was assessed 300 seconds after the application of the nominal load. Overload Deflection 1 is the additional immersion with a 33% increase in load from the nominal load. Overload Deflection 2 is the additional immersion with a 66% increase in load from the nominal load. Results for the support surface cohort using the ISO test method with the 40-mm cushion loading indenter can be seen in Table 2. Results for the CMS PDAC test method for General Use cushions with the 25-mm cushion loading indenter are shown in Table 3.

TABLE 2

LCD and ODs using ISO test method and 40-mm cushion loading indenter.

| | CMS Pass/Fail Contact | Overload Deflection 1 [mm] | CMS Pass/Fail Overload | Overload Deflection 2 [mm] |
|---|---|---|---|---|
| Support Surface 5 [no cover] | Pass | 7.5 | Pass | 15.6 |
| Support Surface 5 [upholstery cover] | Pass | 4.7 | Pass | 10.1 |
| Support Surface 5 [upholstery cover with shear reduction feature 60] | Pass | 5.8 | Pass | 13.3 |
| Competitor 1 | Pass | 2.9 | Pass | 7.3 |
| Competitor 2 | Fail | 3 | Pass | 5.9 |
| Competitor 3 | Pass | 4.8 | Pass | 8.2 |
| Competitor 4 | Pass | 3.2 | Pass | 6.1 |
| Competitor 5 | Pass | 4.5 | Pass | 9.5 |
| Competitor 6 | Pass | 4.9 | Pass | 10.8 |
| Competitor 7 | Pass | 5.5 | Pass | 10.6 |
| Competitor 8 | Pass | 5.5 | Pass | 13.2 |
| Competitor 9 | Fail | 5.6 | Pass | 10.4 |

TABLE 3

LCD and ODs using CMS PDAC method and 25-mm cushion loading indenter.

| | CMS Pass/Fail Contact | Overload Deflection 1 [mm] | CMS Pass/Fail Overload | Overload Deflection 2 [mm] |
|---|---|---|---|---|
| Support Surface 5 [no cover] | Pass | 7.8 | Pass | 15.3 |
| Support Surface 5 [upholstery cover] | Pass | 4.3 | Pass | 9.1 |
| Support Surface 5 [upholstery cover with shear reduction feature 60] | Pass | 6.7 | Pass | 13.5 |
| Competitor 1 | Pass | 3.8 | Pass | 7.1 |
| Competitor 2 | Fail | 2.5 | Pass | 5 |
| Competitor 3 | Pass | 4.1 | Pass | 8.2 |
| Competitor 4 | Pass | 3.6 | Pass | 6.1 |
| Competitor 5 | Pass | 3.8 | Pass | 8 |
| Competitor 6 | Pass | 4.9 | Pass | 10.9 |

TABLE 3-continued

LCD and ODs using CMS PDAC method and 25-mm cushion loading indenter.

| | CMS Pass/Fail Contact | Overload Deflection 1 [mm] | CMS Pass/Fail Overload | Overload Deflection 2 [mm] |
|---|---|---|---|---|
| Competitor 7 | Pass | 5.6 | Pass | 11.7 |
| Competitor 8 | Pass | 5 | Pass | 11.1 |
| Competitor 9 | Fail | 4.7 | Pass | 9.6 |

While a majority of the support surfaces passed the loaded contour depth and overload deflection tests, the degree of immersion varied slightly. A support surface exhibiting higher additional immersion under the overload conditions evidences higher margins of safety against inducing a pressure injury. The support surface 5 described herein demonstrated the strongest immersive qualities.

It is particularly noteworthy to assess the differences of immersion across the three variations of the example seating surface 5. Across both analyses, the support surface 5 having no upholstery cover demonstrated the largest degree of immersion, while the support surface 5 having only a traditional upholstery cover yielded the lowest degree of immersion. The difference in immersion can be explained due to the frictional interface between the support surface 5 and the traditional upholstery cover. When a user sits on a support surface having a traditional upholstery cover, shear strain is induced on the user's tissues (Ruffini corpuscles) in regions where the upholstery cover and the support surface exhibit a high COF (e.g., under a user's bony prominences), thus causing the upholstery cover to bite and thereby preventing the user from freely immersing into the support surface. By implementing a low-friction interface between the support surface and the upholstery cover, the frictional barrier can be separated, allowing a user to immerse into and/or adjust position in the support surface without inducing pressure or shear strain across a plane of the support surface. The effect of the shear reduction feature 60 can be clearly observed when compared to the variations without the feature.

Example 2

Maintaining the pelvis within three degrees of neutral alignment aids in promoting proper posture while seated. The example support surface 5 is configured such that the pelvic well 12 and inclined surface 14 aid in providing a force in the posterior direction to stabilize the pelvis and prevent translation or shear strain in the anterior direction on the seat support surface 5, thereby positioning the user over pressure and shear strain relief features. The contour of the top surface 10 better matches the negative surface of the human body in a seated position than a flat seating surface. Matching the shape helps to greatly reduce seating pressures under the IT's and coccyx compared to flat-topped seating surfaces or cushions. The raised sides 15 are also complimentarily contoured to match the user's shape to help load the tissue and muscle lateral to the pelvis and along the femur area. This surface helps carry the load of the patient and redistributes pressures over a greater sitting area. A Horizontal Stiffness test was conducted to quantify and characterize the support surface's response to slight horizontal movements in the forward direction, thus indicating resistance to pelvic movement. Procedures from ISO 16840-2:2018 Annex C were followed and are described herein:

1) The cushion is loaded with a rigid cushion loading indenter to 500N;
2) The loaded indenter is pulled 10 mm in the forward direction and the Peak Force (N) to pull the indenter is measured; and
3) The position is held and after 60 seconds the pull force (N) is again recorded.

Two key outcomes of this test as defined in ISO 16840-2:2018 Annex C are Peak Force (N) and Force at 60 seconds (N). The Peak Force is the maximum horizontal force required to displace a loaded cushion indenter forward 10 mm. The Force at 60 seconds is the final force measured after the 60 second hold time after displacement. In addition to the procedures and outcomes outlines in ISO 16840-2:2018 Annex C, a shear sensor was attached on the lowest basepoint on one side of the indenter (simulating the ischial tuberosity) at the interface between the indenter and the cushion to obtain Shear Force (N) at 60 seconds after displacement. Horizontal Stiffness test results can be seen in Table 4.

TABLE 4

Peak Horizontal Force (N), Horizontal Force at 60 seconds (N), Shear Force at 60 seconds averaged over three trials with a 10 mm pull.

| | Peak Horizontal Force [N] | Horizontal Force at 60 Seconds [N] | Shear Force at 60 Seconds [N] |
|---|---|---|---|
| Support Surface 5 [no cover] | 271 | 222 | 13.5 |
| Support Surface 5 [upholstery cover] | 249 | 207 | 12 |
| Support Surface 5 [upholstery cover with shear reduction feature 60] | 227 | 182 | 7.2 |
| Competitor 1 | 287 | 154 | 17.1 |
| Competitor 2 | 171 | 140 | 21.2 |
| Competitor 3 | 243 | 211 | 16.1 |
| Competitor 4 | 260 | 226 | 23 |
| Competitor 5 | 167 | 138 | 16 |
| Competitor 6 | 254 | 198 | 13 |
| Competitor 7 | 208 | 172 | 12.9 |
| Competitor 8 | 228 | 190 | 10.5 |
| Competitor 9 | 246 | 212 | 10 |

A higher Peak or Final Force, meaning a higher "Horizontal Stiffness" outcome, may offer more stability as individuals make slight shifts on the cushion. However, there is an increased chance of tissue deformation due to shear forces between the seat cushion and buttocks, therefore a noteworthy combination is high horizontal stiffness values and low shear force. The average peak horizontal force across all trials was 234 N, while the average horizontal force after 60 seconds was 187 N. Particularly noteworthy is the difference between the three variations. While all three variations of the support surface 5 exhibited strong stiffness against the horizontal force, the example support surface 5 including the shear reduction feature 60 yielded the lowest shear force across all trials, varying significantly in comparison to the variations of the support surface not including the shear reduction feature.

Example 3

The ability of a support surface to evenly disperse and reduce peak pressures may offer greater comfort and support for a user while sitting for extended periods of time. Interface pressure can be quantified using the Pressure Mapping test. The pressure mapping test utilizes interface pressure measurements to assess the magnitude and distribution of pressure on a loaded cushion (support surface). The following procedures from ISO 16840-6:2015 Clause 14 were followed:

1) The cushion is loaded with a rigid cushion loading indenter and load totaling 500N and pressure map placed at the interface between the cushion and indenter records for 60 seconds;
2) Guidance on interpretation of the pressure map and base zones. Representation of a pressure map that shows a Right Base Zone (RBZ) and a Left Base Zone (LBZ) as well as sacral or Central Zone (CZ).

It should be noted that this method is not a validated and standardized test method and is intended to be used to compare pressure mapping metrics before and after simulated aging. The standard defines several key outcomes for the interface pressure measurement test related the base zones highlighted in FIG. 22 including: Peak Pressure Index for the right and left base zones; Percent total force for the right, left and center base zones; Dispersion Index; and Contact Area. For more information on these metrics please reference ISO 16840-6:2015 Clause 14. A BT2-3232-200 BodiTrak2 pressure mat that has a 32×32 array and 47 cm×47 cm sensing area was used for pressure mapping pressure measurements. Each sensor is 11 mm×11 mm with 2 mm spacing. The maximum recorded value was 200 mm Hg.

Figure 22:
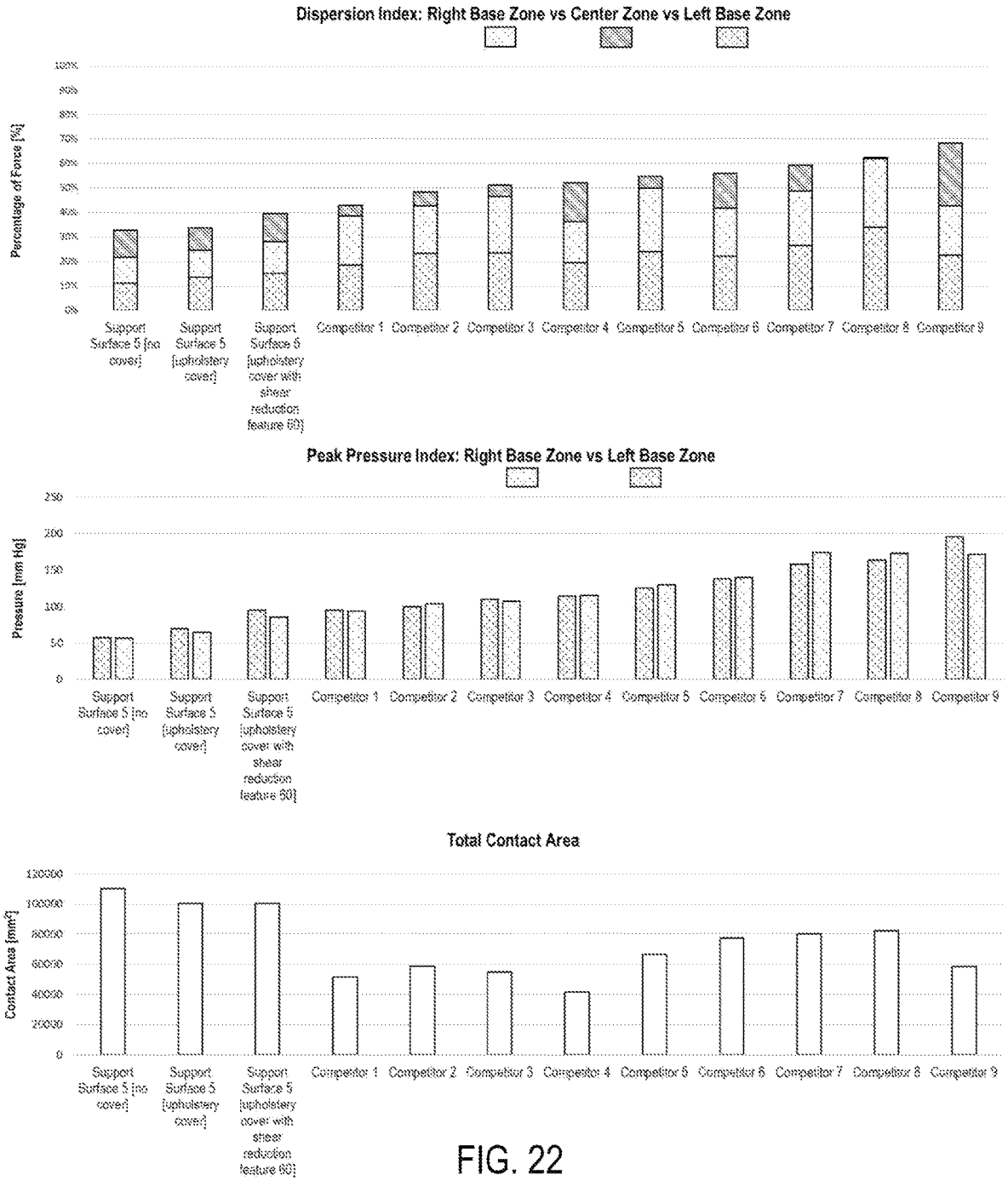
FIG. 22 depicts example results of a pressure mapping test conducted according to ISO 16840-6:2015, clause 14.

Dispersion may be defined as the percentage of force supported in a particular area or zone relative to the total amount of force. In other words, a dispersion index quantifies the ability of the cushion to disperse peak pressures and is inversely related to immersion. Therefore, a low percentage of dispersion is desirable, meaning a low percentage of weight/force is transposed to the tissues of a user in each zone (RBZ, LBZ, CZ). The results from the pressure mapping test provide a strong indication of immersive qualities for all support surfaces tested. Referring to FIG. 22, the example support surface 5 with no upholstery cover exhibited the smallest percentage of dispersion across all trials, the remaining variations of the support surface 5 tested performed comparatively. Similarly, each variation of the support surface 5 demonstrated a greater reduction in peak pressures versus the competitor support surfaces.

The ability of a support surface to envelope and support a user further evidences strong immersive properties. Referring again to FIG. 22, a comparison of total contact area between the user 40 and the support surface demonstrated that the example support surface 5 described herein provided the greatest amount of surface area contact, which in turn aided in reducing peak pressures and yielded a low dispersion percentage. Specifically, the example support surface 5 is configured such that the pelvic well 12 and inclined surface 14 aid in providing a force in the posterior direction to stabilize the pelvis and prevent translation or shear strain in the anterior direction on the seat support surface 5. The contour of the top surface 10 better matches the negative surface of the human body in a seated position than a flat seating surface. The results indicate that matching the shape helped to greatly reduce seating pressures under the IT's and coccyx compared to competitor seating surfaces or cushions.

Example 4

As demonstrated in examples 1-3, immersion and stiffness tests provide important metrics in characterizing a support surface's ability to disperse tissue pressures and cradle a user's pelvis to promote and maintain proper postural alignment. These tests, however, do not account for the circumstance in which a user may lean from side to side. The Lateral Stability test evaluates the support surface's ability to resist moments at the pelvis. Moments in the test method are created with an off-center load applied to a standard indenter simulating the buttocks and upper thighs. Resulting indenter tilt angles are measured to characterize the cushion response. The intended use of the method is to differentiate stability performance between cushion models. The following procedure was followed according to ISO 16840-13:

1) The cushion is loaded with a live load (the (60%) portion of the load that translates in the horizontal plane to shift the center of mass relative to the test cushion)) and dead load (the (40%) portion of the total load, including the rigid cushion loading indenter, that does not translate in the horizontal plane relative to the test cushion) totaling 500N;
2) The indenter is leveled and the initial angle is recorded;
3) The dead load is shifted 75 mm laterally to create a tilt condition; and
4) The tilt angle is recorded every 10 seconds for 60 seconds after the shift is applied.

The main outcome of this test is the change in tilt angle, which indicates the amount of rotation of the indenter allowed by the cushion. Changes in lateral tilt are averaged over five trials and measured every 10 seconds for 60 seconds after a 75 mm lateral weight shift is applied. Anterior-posterior tilt was measured at 0 and 60 seconds (this is a deviation from ISO 16840-13). A second version of this test was conducted using a shear sensor placed under the ITs of the RCLI. Shear Force (N) and Interface Pressure (mm Hg) recordings were taken after 60 seconds of the tilt application and averaged over three trials. Lateral Stability test results can be seen in Table 5. Lateral stability with shear results can be seen in Table 6.

TABLE 5

Average lateral tilt of five trials at each time point.

| | Lateral Tilt [degrees] | | | | | |
|---|---|---|---|---|---|---|
| | 10 s | 20 s | 30 s | 40 s | 50 s | 60 s |
| Support Surface 5 [no cover] | 5.6 | 5.8 | 5.9 | 6 | 6 | 6 |
| Support Surface 5 [upholstery cover] | 4.1 | 4.1 | 4.2 | 4.3 | 4.3 | 4.3 |
| Support Surface 5 [upholstery cover with shear reduction feature 60] | 5.1 | 5.3 | 5.4 | 5.4 | 5.4 | 5.5 |
| Competitor 1 | 3.9 | 3.9 | 3.9 | 3.9 | 3.9 | 3.9 |
| Competitor 2 | 3.7 | 3.7 | 3.8 | 3.8 | 3.8 | 3.9 |
| Competitor 3 | 3 | 3 | 3 | 3 | 3 | 3 |
| Competitor 4 | 3.5 | 3.5 | 3.5 | 3.5 | 3.5 | 3.5 |
| Competitor 5 | 2.7 | 2.7 | 2.8 | 2.8 | 2.8 | 2.8 |
| Competitor 6 | 4.7 | 4.9 | 4.9 | 5 | 5 | 5 |
| Competitor 7 | 4.8 | 4.9 | 5 | 5 | 5 | 5.1 |
| Competitor 8 | 3.9 | 4 | 4 | 4.1 | 4.1 | 4.2 |
| Competitor 9 | 5.2 | 5.3 | 5.4 | 5.4 | 5.4 | 5.4 |

TABLE 6

Shear force and interface pressure of three trials after 60 seconds.

| | Shear Force [N] | Interface Pressure [mm Hg] |
|---|---|---|
| Support Surface 5 [no cover] | −5.6 | 47 |
| Support Surface 5 [upholstery cover] | 1.5 | 61 |
| Support Surface 5 [upholstery cover with shear reduction feature 60] | 0.1 | 61 |
| Competitor 1 | 7 | 139 |
| Competitor 2 | 8 | 145 |
| Competitor 3 | −3.6 | 109 |
| Competitor 4 | −16.7 | 140 |
| Competitor 5 | 7.6 | 150 |
| Competitor 6 | 1 | 110 |
| Competitor 7 | 10.4 | 155 |
| Competitor 8 | 12.5 | 153 |
| Competitor 9 | 9.9 | 160 |

A static tilt angle, meaning a tilt angle that is maintained across the duration of the trial, evidences a stable support surface when presented with an off-center load. Maintaining a static tilt angle is important in preventing a user from over-tilting. Under these circumstances, a user may experience heightened tissue strain. Therefore, a noteworthy combination is the ability of a cushion to maintain a static tilt angle while continuing to evenly disperse pressure and maintain a minimal change in shear force. While each variation of the support surface 5 performed well as compared to the competitor cushions, the results of the lateral stability test indicate that the support surface 5 having the pressure reduction feature 25 and shear reduction feature 60 described herein provided strong support and minimal shearing when presented with an uneven load. The variation of the support surface 5 including the shear reduction feature demonstrated a considerable improvement in reducing shear, and thus strain, experienced by a user. As discussed herein, the low-friction interface provided between the support surface 5 and the upholstery cover prevented the cover from biting or catching the support surface, thereby preventing shear across a plane of the seating surface.

One or more of the disclosed embodiments, alone or in combination, may provide one or more technical effects including reducing sitting peak pressures on the user so that the user is comfortable for extended periods of time in a seat having the support surface described herein. The technical effects and technical problems in the specification are exemplary and are not limiting. It should be noted that the embodiments described in the specification may have other technical effects and can solve other technical problems.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom," "left" and "right") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only, and not limiting. Although only a few embodiments have been described in detail in this disclosure, those skilled in the art who review this disclosure will readily appreciate that many various alternatives, modifications, variations, improvements and/or substantial equivalents, whether known or that are or may be presently foreseen, are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes, and omissions may be made in the design, operating conditions, and arrangement of the various examples of embodiments without departing from the spirit or scope of the present inventions. Therefore, the invention is intended to embrace all known or earlier developed alternatives, modifications, variations, improvements and/or substantial equivalents.

The invention claimed is:

1. A chair comprising:

a base;

a support surface provided on the base, the support surface comprising a single unitary body formed of a single-density substrate, the support surface further comprising:

a top surface contoured to accommodate a pelvis of a user;

a bottom surface; and cutouts extending into a portion of the support surface from the bottom surface towards the top surface, the cutouts being positioned beneath an expected location of a user's bony prominences and configured to provide a controlled structural collapse of the support surface by varying a stiffness in a cross-section;

a fabric cover coupled to the support surface; and a low-friction interface positioned between the support surface and the fabric cover and extending across a top surface of the support surface, the low-friction interface positioned between the support surface and the expected location of the bony prominences of the user, the interface comprising a low-friction fabric.

2. The chair of claim 1, wherein the cutouts are geometric shapes selected from the group consisting of a dome, a flat-topped dome, a pyramid, a flat-topped pyramid, a box, a rectangular prism, a cone, a flat-topped cone, a cylinder, and a tapered cylinder.

3. The chair of claim 1, wherein the support surface and the cutouts are configured such that when the user sits on the support surface, a peak pressure on the user is less than about 81 mm Hg.

4. The chair of claim 1, wherein the cutouts include a pair of identical cutouts, the pair of identical cutouts being symmetric about a sagittal plane of the support surface, and wherein the cutouts are positioned nearer to a back edge of the support surface than a front edge of the support surface.

5. The chair of claim 1, wherein the low-friction fabric comprises an anisotropic fabric having a primary side and a secondary side, the primary side comprising a close-knit ribbed pattern.

6. The chair of claim 5, wherein the low-friction interface comprises a first low-friction fabric surface and a second low-friction fabric surface provided on the first low-friction fabric surface, the primary side of the first low-friction fabric surface being positioned face to face with the primary side of the second low-friction fabric surface such that the close-knit ribbed pattern of the first low-friction fabric surface is arranged perpendicular relative to the close-knit ribbed pattern of the second low-friction fabric surface.

7. The chair of claim 1, wherein the low-friction fabric comprises a close-knit fabric having a primary stitch direction and a secondary stitch direction, the primary stitch direction comprising a fine rib stitch pattern.

8. A support surface assembly for a user, the support surface assembly comprising:

a support surface being a single unitary body formed of a single-density substrate and a cutout integrated into a bottom surface of the support surface, the cutout to provide a controlled structural collapse of the support surface by varying a stiffness in a cross-section of the support surface;

a fabric cover coupled to the support surface; and a low-friction interface positioned between the support surface and the fabric cover and extending across a top surface of the support surface, the low-friction interface positioned between the support surface and bony prominences of the user, and the low-friction interface including a low-friction fabric having a primary face comprising a ribbed pattern.

9. The support surface assembly of claim 8, wherein the cutout is geometric shaped, such as a shape selected from the group consisting of a dome, a flat-topped dome, a pyramid, a flat-topped pyramid, a box, a rectangular prism, a cone, a flat-topped cone, a cylinder, and a tapered cylinder.

10. The support surface assembly of claim 8, wherein the cutout has a double dome shape, the double dome shape defined by a first indentation extending into the support surface a first distance and a second indentation at least partially overlapping the first indentation extending into the support surface a second distance, the first distance being greater than the second distance.

11. The support surface assembly of claim 8, wherein the low-friction fabric is a close-knit fabric having a primary stitch direction and a secondary stitch direction, the primary stitch direction comprising a fine rib stitch pattern.

12. The support surface assembly of claim 8, wherein the low-friction interface comprises a first low-friction fabric surface and a second low-friction fabric surface provided on the first low-friction fabric surface, the primary face of the first low-friction fabric surface being positioned face to face with the primary face of the second low-friction fabric surface such that the ribbed pattern of the first low-friction fabric surface is arranged perpendicular relative to the ribbed pattern of the second low-friction fabric surface.

* * * * *